US006157799A

United States Patent [19]

Asakura et al.

[11] Patent Number: 6,157,799

[45] Date of Patent: Dec. 5, 2000

[54] COLOR IMAGE FORMING APPARATUS, IMAGE FORMING UNIT THEREFOR, AND TRANSFER BELT UNIT THEREFOR

[75] Inventors: Kenji Asakura; Masanori Yoshikawa, both of Osaka; Noboru Katakabe, Kyoto, all of Japan

[73] Assignee: Matsushita Electric Industrial Co., Ltd., Osaka, Japan

[21] Appl. No.: 09/095,286

[22] Filed: Jun. 10, 1998

[30] Foreign Application Priority Data

Jun. 16, 1997 [JP] Japan ..... 9-158975

[51] Int. Cl.[7] ..... G03G 15/00; G03G 15/01

[52] U.S. Cl. ..... 399/167; 399/121; 399/223; 399/229; 399/302

[58] Field of Search ..... 399/110, 111, 399/112, 113, 121, 167, 226, 227, 228, 223, 302, 308, 299

[56] References Cited

U.S. PATENT DOCUMENTS

| | | | |
|---|---|---|---|
| 4,662,739 | 5/1987 | Sakai et al. . | |
| 4,743,938 | 5/1988 | Ohno . | |
| 4,847,660 | 7/1989 | Wheatley, Jr. et al. | 399/167 |
| 5,255,063 | 10/1993 | Ideyama et al. . | |
| 5,325,151 | 6/1994 | Kimura et al. . | |
| 5,438,398 | 8/1995 | Tanigawa et al. | 399/302 |
| 5,442,428 | 8/1995 | Takahashi et al. . | |
| 5,515,140 | 5/1996 | Atsumi et al. . | |
| 5,528,343 | 6/1996 | Tada et al. | 399/113 |
| 5,565,975 | 10/1996 | Kumon et al. . | |
| 5,570,160 | 10/1996 | Miwa et al. | 399/167 X |
| 5,585,911 | 12/1996 | Hattori et al. . | |
| 5,587,769 | 12/1996 | Sawada et al. | 399/113 |
| 5,587,783 | 12/1996 | Nakamura et al. . | |
| 5,610,701 | 3/1997 | Terada et al. . | |
| 5,612,771 | 3/1997 | Yamamoto et al. | 399/121 X |
| 5,666,596 | 9/1997 | Yoo | 399/111 |
| 5,669,046 | 9/1997 | Yoshida et al. | 399/167 |
| 5,787,326 | 7/1998 | Ogawa et al. | 399/121 X |
| 5,809,380 | 9/1998 | Katakabe et al. | 399/227 |
| 5,887,228 | 3/1999 | Motohashi et al. | 399/111 |
| 5,943,540 | 8/1999 | Okamoto et al. | 399/302 |

FOREIGN PATENT DOCUMENTS

| | | |
|---|---|---|
| 62-287264 | 12/1987 | Japan . |
| 63-109462 | 5/1988 | Japan . |
| 2-12271 | 1/1990 | Japan . |
| 2-311864 | 12/1990 | Japan . |
| 4-245856 | 9/1992 | Japan . |
| 4-324881 | 11/1992 | Japan . |
| 6-27829 | 2/1994 | Japan . |
| 7-36246 | 2/1995 | Japan . |
| 7-84430 | 3/1995 | Japan . |
| 7-104540 | 4/1995 | Japan . |
| 8-63057 | 3/1996 | Japan . |
| 8-137171 | 5/1996 | Japan . |
| 8-314286 | 11/1996 | Japan . |

*Primary Examiner*—Susan S.Y. Lee
*Attorney, Agent, or Firm*—Merchant & Gould P.C.

[57] ABSTRACT

A color image forming apparatus having a plurality of image forming units with each unit having a developing device and a photoconductive drum with a driven coupling device. A conveying device switches the plurality of image forming units by moving them successively between an image forming position and a waiting position. A photoconductive drum driving device removably engages the driven coupling device of the image forming unit that is positioned in the image forming position and having one driving coupling device for coaxially rotating the photoconductive drum of the image forming unit positioned in the image forming position together as one body. The photoconductive drum positioned in the image forming position is in contact with a transfer device wherein a peripheral velocity of either the photoconductive drum or the transfer device during use is higher than the a peripheral velocity of the other.

26 Claims, 14 Drawing Sheets

COLOR IMAGE FORMING APPARATUS, IMAGE FORMING UNIT THEREFOR, AND TRANSFER BELT UNIT THEREFOR

FIELD OF THE INVENTION

The present invention relates to a color image forming apparatus used in, for example, a color printer, a color copying machine or a color facsimile. More specifically, the present invention relates to a color image forming apparatus that forms a color image by superimposing toner images of various colors using electrophotography.

BACKGROUND OF THE INVENTION

A conventional color image forming apparatus is disclosed, for example, in Publication of Unexamined Patent Application (Tokkai) No. Hei 7-36246.

FIG. 14 explains such a conventional color image forming apparatus. As shown in FIG. 14, this apparatus comprises an intermediate transfer belt unit 201 including an intermediate transfer belt 202, a primary transfer roller 203, a secondary transfer roller 204, a cleaner roller 205, and a waste toner reservoir 206. Superimposition of color images is performed on the transfer belt 202. In the middle of the printer, a group of image forming units 208 is provided. Four image forming units 207Bk, 207Y, 207M and 207C for black, yellow, magenta and cyan, each unit being of sector shape in cross section, are arranged circularly to form a group of image forming units 208. When an image forming unit 207Bk, 207Y, 207M or 207C is installed properly in the color image forming apparatus, mechanical driving systems and electrical connection systems are coupled between the image forming units 207Bk, 207Y, 207M and 207C and other portions of the color image forming apparatus via mutual coupling members, so that both sides are mechanically and electrically connected. The image forming units 207Bk, 207Y, 207M and 207C are supported by a supporter and collectively rotated by a motor, so that they can revolve around a non-rotatable cylindrical shaft 209. For image formation, the image forming units 207Bk, 207Y, 207M and 207C are successively moved by rotation to an image forming position 210, where they oppose the primary transfer roller 203 spanning the intermediate transfer belt 202. The image forming position 210 is also the exposure position for exposure with a laser beam 211.

A laser exposing device 212 is arranged horizontally below the group of image forming units 208. The laser signal beam 211 passes through a light path opening 213 between the magenta and cyan image forming units 207M and 207C, and through an opening provided in the cylindrical shaft 209, and enters a mirror 214, which is fixed inside the shaft 209. The laser signal beam 211 reflected by the mirror 214 enters the black image forming unit 207Bk located at the image forming position 210 through an exposure opening 215. Then, the laser signal beam 211 passes through a light path between a developing device 216 and a cleaner 217, arranged on the upper and the lower side in the image forming unit 207Bk, enters an exposure portion on the left side of a photoconductive drum 218, and scans for exposure along the direction of the axis of the photoconductive drum 218. The toner image formed on the photoconductive drum 218 is transferred to the intermediate transfer belt 202. Then, the group of image forming units 208 rotates 90 degrees, so that the yellow image forming unit 207Y moves into the image forming position 210. An operation similar to the above formation of the black image is performed to form a yellow toner image overlaying the black toner image previously formed on the intermediate transfer belt 202. Similar operations as explained above are performed using the magenta and cyan image forming units 207M and 207C to compose a full color image on the intermediate transfer belt 202. After the full color image on the intermediate transfer belt 202 is completed, a recording paper is conveyed by a secondary transfer roller 204 and a tertiary transfer roller 219, and the color image is simultaneously transferred onto the recording paper. The recording paper onto which the color image has been transferred is conveyed to a fuser 220, which fuses the color image on the recording paper.

In an example of a conventional mechanism for coupling and driving, FIG. 15 shows how the driving mechanism on the main body side is coupled to the photoconductive drum. In FIG. 15, the main shaft 235 of the photoconductive drum 218 that has arrived at the image forming position 210 (see FIG. 14) is positioned by some means not illustrated in the drawing, and a gear 232, which is fixed to one end of the main shaft, engages a gear 241 provided at an output shaft 245 on the main body side. Thus, a driving force is transmitted from the main body side to the photoconductive drum 218.

In Publication of Unexamined Japanese Patent Application No. Hei 2-12271, the number of rotations of the driving shaft per rotation of the belt transfer device is an integer, which prevents a misalignment between the colors due to a periodic change of the peripheral velocity of the belt resulting from an eccentric component of the driving shaft of the belt transfer device.

Similarly, the number of rotations of the photoconductive drum per rotation of the belt transfer device is an integer, which prevents a misalignment of the colors due to a periodic change of the peripheral velocity of the photoconductive drum resulting from an eccentric component of a single photoconductive drum and the gear driving the photoconductive drum.

Publication of Japanese Unexamined Patent Publication No. Hei 4-324881 uses a single photoconductive drum, and discloses employing a speed difference in a certain direction between the photoconductive drum and the transfer device to prevent sharp variations of dynamic friction due to a change in the peripheral velocity of the two.

Similarly, Publication of Japanese Unexamined Patent Publication No. Hei 8-314286 discloses rotating a single photoconductive drum faster than an intermediate transfer belt, so that a braking force overcoming the friction force on a contact portion of the two is applied on the belt driving shaft.

In order to record a full color image with high precision, an accurate alignment of four colors is necessary. When a single photoconductive drum is used, the rotational phase of the photoconductive drum usually can be synchronized with the rotation of the transfer belt and thus a relative misalignment of the color images can be prevented even though the absolute image may be expanded or contracted.

However, devices that form a color image by successively switching four photoconductive drums for all colors and superimposing these colors are subject to many problems, such as variations in the accuracy and circularity of the outer diameter of the photoconductive drums, digression from the transmission angle velocity in the parts coupling the photoconductive drum with the driving mechanism on the main body side, variations in the rotation speed of the driving mechanism itself, and variations in the positioning of the photoconductive drum into a certain position. Therefore, precise positioning is difficult and there is a need for a solution of these problems.

For example, when a color image forming apparatus uses a conventional coupling/driving mechanism with gears as shown in FIG. 15 to successively switch a plurality of photoconductive drums 218, the angular velocity of the output shaft 245 on the main body side cannot be precisely transmitted to the photoconductive drum 218, because of the differences between the different photoconductive drum gears 232. Especially in a color image forming apparatus where the image forming units integrate a photoconductive drum with other process members and the image forming units are frequently switched during use, the gear precision can worsen and adjustment for positioning can become very difficult when cheap plastic parts are used for the photoconductive drum gears 232. Therefore, the precision with which the angular velocity is transmitted from the output shaft 245 on the main body side to the photoconductive drum 218 deteriorates even further, and each photoconductive drum rotates with a different fluctuation pattern in its angular velocity. Since slippage with the transfer belt cannot cancel out variations in the recording pitch of the toner image on the photoconductive drum caused by angular velocity fluctuations, a relative misalignment of the toner image colors recorded on the photoconductive drums occurs, which results in color misalignment.

Moreover, in a color image forming apparatus that successively switches a plurality of photoconductive drums, fluctuations in the peripheral speed of the photoconductive drums resulting from an eccentricity of the photoconductive drum and flanges cannot be synchronized with the transfer belt, even when the periodic phase variations of the angular velocity of the driving system for the photoconductive drum are synchronized with the transfer belt. Therefore, the fluctuation pattern arising from different velocities in a contact portion between the photoconductive drum and the transfer belt results in different phases for each color. Moreover, fluctuations in the friction force caused by fluctuations in the distance that the photoconductive drum indents into the transfer belt result in different amplitudes and phases for each color. Therefore, it is not possible to prevent color misalignment caused by velocity fluctuations of the photoconductive drum and the transfer belt resulting from bending and twisting of the driving system under load fluctuations. Especially, when the image forming units comprising the photoconductive drums are removable, adjustments such as phase alignment become very difficult.

It is a purpose of the present invention to solve these problems of the prior art and provide a color image forming apparatus that forms a full-color image by successively switching a plurality of photoconductive drums into one image forming position and ensures very precise color alignment with a simple structure.

SUMMARY OF THE INVENTION

In order to achieve these purposes, a color image forming apparatus comprises a plurality of image forming units, each image forming unit comprising a developing device for a different color and a photoconductive drum having driven coupling means; conveying means for switching said plurality of image forming units by moving them successively between an image forming position and a waiting position; photoconductive drum driving means removably engaging said driven coupling means of said image forming unit that is positioned in the image forming position and having driving coupling means for coaxially rotating said photoconductive drum together as one body. According to a first configuration of such a color image forming apparatus, an angular velocity of the power side can be correctly transmitted to the photoconductive drum via a coupling portion between the apparatus main body and the image forming units, so that variations between the image forming units, arising from the coupling portion, can be eliminated.

It is preferable that the color image forming apparatus according to the first configuration of the color image forming apparatus of the present invention further comprises exposure means for exposing said photoconductive drum that is positioned in the image forming position; transfer means for forming a color image comprising a plurality of superimposed color toner images on a transfer device by successively superimposing toner images formed with said developing device on said photoconductive drum that is positioned in the image forming position and transferring them onto said transfer device; and transfer device driving means for driving said transfer device at a certain velocity. In this case, it is also preferable that during image transfer, at a transfer portion where toner is transferred from said photoconductive drum of the image forming unit positioned in the image forming position to the transfer device, the peripheral velocity of either said photoconductive drum or said transfer device is higher than the peripheral velocity of the other. According to this preferable configuration, fluctuations in the peripheral velocity of the photoconductive drum, caused by eccentric components of the photoconductive drum circumference with regard to the rotation axis, can be absorbed by slippage between the photoconductive drum and the transfer device, which is driven at a constant velocity, so that the toner images can be aligned precisely on the transfer device, even when there are variations in the accuracy of the coupling means. It is even more preferable that the transfer portion where toner is transferred from said photoconductive drum that is positioned in the image forming position to the transfer device, the peripheral velocity of said transfer device is constantly higher than the peripheral velocity of said photoconductive drum at its area of contact with said transfer device. Furthermore, it is preferable that a rotation ratio of the driving coupling means, per rotation of the transfer device at image formation time, is an integer. According to this preferable configuration, the difference between the angular velocity of the photoconductive drum and the peripheral velocity of the transfer device, which arises from the driving mechanism on the main body side regardless of the photoconductive drum, can be synchronized for each color. Therefore, an image can be recorded with high precision and without positional misalignment, even when a plurality of photoconductive drums with fluctuations in the dimensional accuracy are used. Moreover, it is preferable that the transfer device is an intermediate transfer belt suspended by at least one driven shaft, which is drivably supported by a driving shaft that rotates said driven shaft at a certain rotation frequency with said transfer device driving means. According to this preferable configuration, the pressure with which the transfer device presses against the photoconductive drum can be controlled, so that the friction force between the transfer device and the photoconductive drum is reduced. As a result, the transfer device is driven with a constant velocity, regardless of the peripheral velocity of the photoconductive drum. It is even more preferable that the color image forming apparatus further comprises a driving shaft load means, which applies to said driving shaft a friction load that is greater than the maximum value of the total driving shaft torque, which rotates said driving shaft in the advance direction and is the sum of the belt rotation torque that said intermediate transfer belt exerts on said driving shaft when rotating and the friction torque in said driving shaft from the friction between said intermediate transfer belt and said photoconductive drum. In this case, the friction force acting between the intermediate transfer belt and the photoconductive drum positioned in the image forming position is smaller than the friction force with which the driving shaft drives said intermediate transfer belt. According to this preferable configuration, the driving shaft and the intermediate transfer belt can be rotated steadily with a certain velocity, regardless of eccentricity or phase of the photoconductive drums. It is even more preferable that the driven shaft for suspending the intermediate transfer belt is integrated with said intermediate transfer belt into a transfer belt unit, and said transfer belt unit is detachable from the apparatus.

Furthermore, in the first configuration of a color image forming apparatus according the present invention, it is preferable that the color image forming apparatus further comprises a developing roller with which the developing device conveys toner onto the photoconductive drum and which presses against said photoconductive drum, the peripheral velocity of this developing roller being higher than the peripheral velocity of said photoconductive drum; and photoconductive drum load means, which applies to said photoconductive drum a friction load that is greater than the maximum value of a total photoconductive drum torque that rotates said photoconductive drum in the advance direction and is the sum of the friction torque between said photoconductive drum and said developing device and the friction torque between said photoconductive drum positioned in the image forming position and said transfer device. According to this preferable configuration, the angular velocity of the photoconductive drum can be maintained at a constant angular velocity regardless of the eccentricity of the photoconductive drum. Especially, with a configuration where the peripheral velocity of the photoconductive drum is usually higher than the peripheral velocity of the surface portion where the transfer device contacts the photoconductive drum, the load torque that the driving shaft load means applies to the belt driving shaft can be reduced, and sufficient tolerance for the recording image length as well as for rubbing when the photoconductive drum is started stopped and switched can be ensured. Moreover, it is preferable that the image forming units are detachable from the apparatus.

A color image forming apparatus in a second configuration of the present invention comprises a plurality of image forming units, each image forming unit comprising a developing device for a different color and a photoconductive drum; conveying means for switching said plurality of image forming units by moving them successively between an image forming position and a waiting position; photoconductive drum driving means, detachably engaging said photoconductive drum, for rotating said photoconductive drum positioned in the image forming position; exposure means for exposing said photoconductive drum that is positioned in the image forming position; transfer means for forming a color image comprising a plurality of superimposed color toner images on an intermediate transfer belt by successively superimposing toner images formed with said developing device on said photoconductive drum that is positioned in the image forming position and transferring them onto said intermediate transfer belt; a plurality of belt shafts for suspending and rotating said intermediate transfer belt; transfer device driving means for driving at least one of said belt shafts at image formation time as a driving shaft at a certain rotation frequency, and stopping said driving shaft when said conveying means is conveying said image forming units; and driving shaft load means for applying a rotation load to said driving shaft. The conveying means conveys said image forming unit for switching while said photoconductive drum rubs along said intermediate transfer belt; and the rotation load that said driving shaft load means exerts on said driving shaft is greater than a rotation torque that static friction force of said photoconductive drum and said intermediate transfer belt exerts on said driving shaft. According to this second configuration of the color image forming apparatus, color switching can be performed with an easy configuration, and image distortion and color misalignment can be prevented.

A color image forming apparatus in a third configuration of the present invention comprises a plurality of image forming units, each image forming unit comprising a developing device for a different color and a photoconductive drum; conveying means for switching said plurality of image forming units by moving them successively between an image forming position and a waiting position; photoconductive drum driving means, detachably engaging said photoconductive drum, for rotating said photoconductive drum positioned in the image forming position; exposure means for exposing said photoconductive drum that is positioned in the image forming position; transfer means for forming a color image comprising a plurality of superimposed color toner images on an intermediate transfer belt by successively superimposing toner images formed with said developing device on said photoconductive drum that is positioned in the image forming position and transferring them onto said intermediate transfer belt; a plurality of belt shafts for suspending and rotating said intermediate transfer belt; transfer device driving means for driving said intermediate transfer belt with at least one of said belt shafts at image formation time as a driving shaft; and driving shaft load means for applying a rotation load to said driving shaft. The friction force acting between the intermediate transfer belt and the photoconductive drum positioned in the image forming position is smaller than the friction force with which said driving shaft drives said intermediate transfer belt, and the friction load that said driving shaft load means applies to said driving shaft is greater than the maximum value of the total driving shaft torque that rotates said driving shaft in the advance direction and is the sum of the belt rotation torque that said intermediate transfer belt exerts on said driving shaft when rotating and the friction torque in said driving shaft from the friction between said intermediate transfer belt and said photoconductive drum positioned in the image forming position. According to this second configuration of the color image forming apparatus, color switching can be performed with an easy configuration, and image distortion and color misalignment can be prevented. Moreover, it is preferable that rotation ratios of the photoconductive drum and the driving shaft, per rotation of the intermediate transfer belt at image formation time, are integers.

According to the second and third configuration of the color image forming apparatus, it is preferable that the belt shafts for suspending the intermediate transfer belt are integrated with said intermediate transfer belt into a transfer belt unit, and said transfer belt unit is detachable from the apparatus.

A color image forming apparatus in a fourth configuration of the present invention comprises a plurality of image forming units, each image forming unit comprising a developing device for a different color and a photoconductive drum; conveying means for switching said plurality of image forming units by moving them successively between an image forming position and a waiting position; photoconductive drum driving means, detachably engaging said photoconductive drum, for rotating said photoconductive drum positioned in the image forming position; exposure means for exposing said photoconductive drum that is positioned in the image forming position; transfer means for forming a color image comprising a plurality of superimposed color toner images on a transfer device by successively superimposing toner images formed with said developing device on said photoconductive drum that is positioned in the image forming position and transferring them onto said transfer device; and transfer device driving means for driving said transfer device with constant velocity at image formation time. During image transfer, at a transfer portion where toner is transferred from said photoconductive drum that is positioned in the image forming position to the transfer device, a peripheral velocity of either said photoconductive drum or said transfer device is constantly higher than a peripheral velocity of the other.

According to the fourth configuration of the color image forming apparatus, it is preferable that at the transfer portion where toner is transferred from said photoconductive drum positioned in the image forming position to the transfer device, the peripheral velocity of said transfer device is constantly higher than the peripheral velocity of said photoconductive drum at its area of contact with said transfer device.

According to the fourth configuration of the color image forming apparatus, it is preferable that a rotation ratio of the photoconductive drum, per rotation of the transfer device at the time of image formation, is an integer.

According to the first–fourth configuration of the color image forming apparatus, it is preferable that the image forming units are detachable from the apparatus.

According to the fourth configuration of the color image forming apparatus, it is preferable that the transfer device is an intermediate transfer belt. In this case, it is also preferable that the belt shaft for suspending the intermediate transfer belt is integrated with said intermediate transfer belt into a transfer belt unit, and said transfer belt unit is detachable from the apparatus.

An image forming unit according to the present invention comprises a developing device for a certain color; and a photoconductive drum having driven coupling means engaging driving coupling means on the main body side of a color image forming apparatus; wherein the image forming unit is detachable from the color image forming apparatus.

A transfer belt unit according to the present invention comprises a driving shaft on the main body side of a color image forming apparatus; at least one driven shaft, which is driven by said driving shaft; and an intermediate transfer belt suspended by said at least one driven shaft; wherein the transfer belt unit is detachable from the main body of the color image forming apparatus.

DESCRIPTION OF THE PREFERRED EMBODIMENTS

The following is a specific explanation of embodiments of the present invention.

First Embodiment

Figure 1:
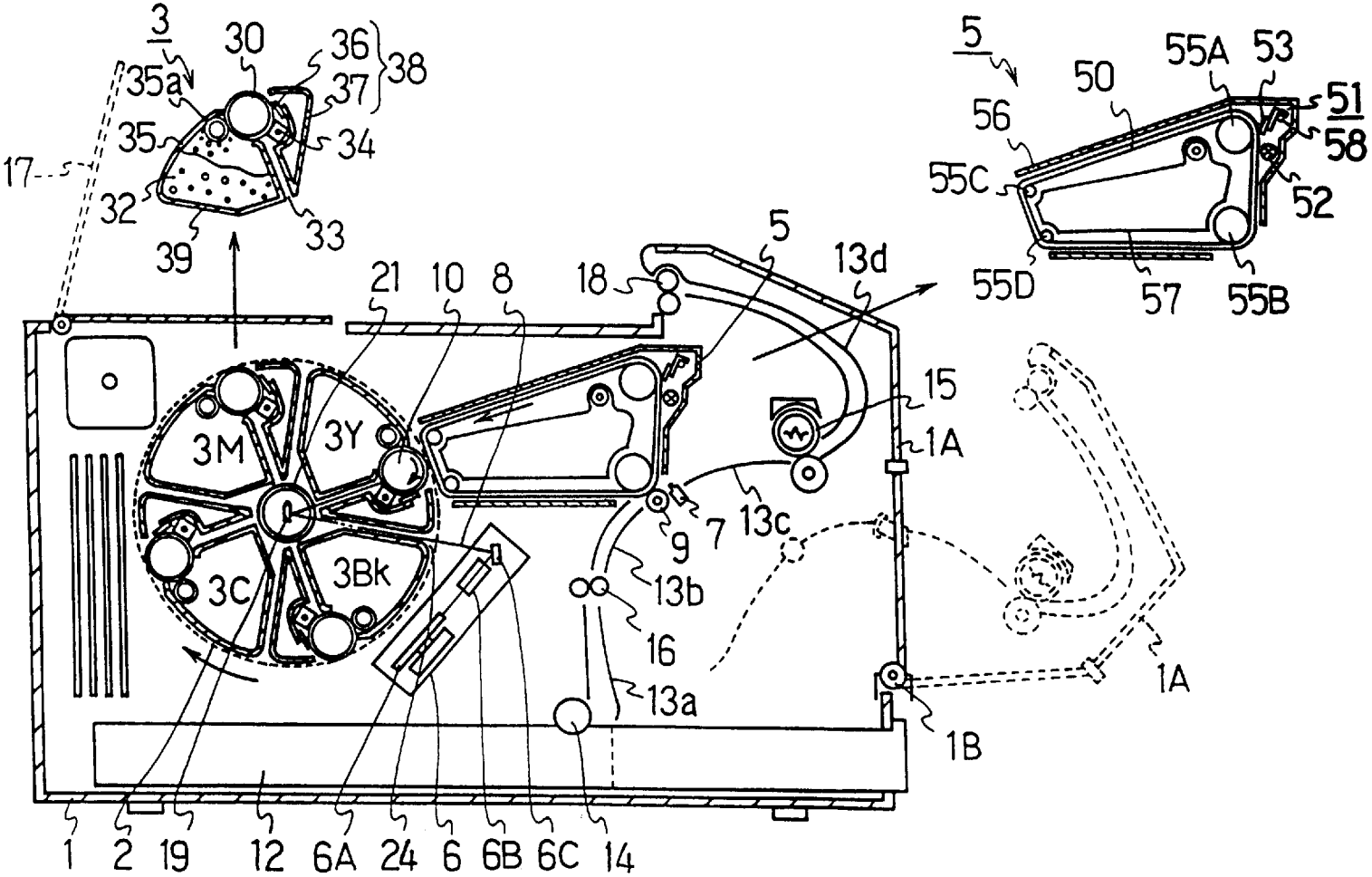
FIG. 1 is a cross section showing the entire color image forming apparatus in a first embodiment of the present invention.

FIG. 1 explains the structure and operation of a color image forming apparatus in a first embodiment of the present invention.

Image Forming Units

In FIG. 1, image forming units 3 are provided for the colors yellow, magenta, cyan and black. The image forming units are integrated devices comprising a photoconductive drum 30 and peripheral process elements, each image forming unit comprising the following parts: a corona charger 34 that charges the photoconductive drum 30 evenly with a negative voltage, a developing device 35 having a developing roller 35*a*, and a toner hopper 39. The developing roller 35*a* is made of an elastic silicone rubber, and presses on the photoconductive drum 30 applying a force of ca. 2 kgf. The toner hopper 39 contains a toner 32 that can be negatively charged and is made of polyester resin and a pigment dispersed in the resin. The toner 32 is carried by the surface of the developing roller 35*a* and develops the photoconductive drum 30. A cleaner 38 cleans remaining toner off the surface of the photoconductive drum 30 after image transfer. This cleaner 38 comprises a cleaning blade 36 made of rubber and a waste toner reservoir 37 that collects waste toner. There is an exposure opening 33 for a laser beam 8 to enter the image forming unit 3. The photoconductive drum 30 has a diameter of 30 millimeters. The developing roller 35*a* has a diameter of about 18 millimeters. The photoconductive drum 30 and the developing roller 35*a* are rotatably mounted on side walls of the image forming unit 3.

Transfer Belt Unit

A transfer belt unit 5 receives a toner image formed on the photoconductive drum 30 at an image forming position 10 and transmits the received toner image onto a recording paper sheet. The transfer belt unit 5 comprises an intermediate transfer belt 50, a roller group 55 (rollers 55A, 55B, 55C and 55D) made of aluminum for suspending the intermediate transfer belt 50, a cleaner 51, and a waste toner container 57 for collecting waste toner. These members are integrated into one transfer belt unit 5, which is detachable from the machine body 1.

The intermediate transfer belt 50 has a thickness of 150 μm and comprises a polycarbonate in the form of a semiconducting (medium electrical resistance) endless belt onto which a surface layer made of a fluororesin such as polytetrafluoroethylene (PTFE) or perfluoroalkylvinylether (PFA) has been coated. A plurality of position detection holes are formed in the intermediate transfer belt 50, so that the positions of the images written onto the intermediate transfer belt can be aligned. The perimeter of the intermediate transfer belt 50 is about 377 mm, which corresponds to the length of A4 paper size (297 mm) plus half the perimeter of the photoconductive drum (30 mm diameter) plus some small allowance. The width of the intermediate transfer belt 50 is about 250 mm.

A cleaner 51 cleans remaining toner off the intermediate transfer belt 50. The cleaner 51 comprises a rubber cleaning blade 53 and a screw 52, which conveys toner scraped by the cleaning blade 53 into the waste toner container 57. This cleaner 51 can be separated from the intermediate transfer belt 50 by rotation around a supporting point 58, so that it does not shave off the toner image from the intermediate transfer belt 50 when a color image is being formed.

Among the roller group 55 suspending the intermediate transfer belt 50, the roller 55A serves as a driving roller for the intermediate transfer belt and as a backup for the cleaning blade 53. The roller 55B serves as a backup roller for the secondary transfer roller 9 for transferring a toner image from the intermediate transfer belt 50 onto a recording paper sheet. The roller 55C is a guide roller, which also applies a primary transfer bias for transferring a toner image from the photoconductive drum 30 to the intermediate transfer belt 50. The roller 55D serves as a tension roller for applying a tension to the intermediate transfer belt 50. The tension roller 55D exerts a tension force of 2–3 kgf on the intermediate transfer belt 50. The intermediate transfer belt 50 is suspended by these rollers 55A, 55B, 55C and 55D and rotates in accordance with the rotation of the driving roller 55A. The friction torque holding the intermediate transfer belt 50 when the driving roller 55A is skidded to rotate the intermediate transfer belt 50 is about 4 kgf×cm.

The diameter of the driving roller 55A and the backup roller 55B is about 30 mm and the diameter of the guide roller 55C and the tension roller 55D is about 20 mm, so that their number of revolutions per revolution of the intermediate transfer belt 50 is an integer.

A cover 56 protects the intermediate transfer belt 50.

Structure of the Entire Apparatus

As shown in FIG. 1, the right side of which corresponds to the front side of the apparatus, a carriage 2 is disposed roughly in the center portion of the machine body 1. On the front side, there is a front alligator opening 1A, and there is a top door 17 on the top side of the apparatus.

The carriage 2 carries four color image forming units 3Y, 3M, 3C, and 3Bk (yellow, magenta, cyan, and black). The carriage 2 is rotatably mounted on a cylindrical shaft 21. Thus, the photoconductive drum 30 of each image forming unit 3 can be rotated successively between the image forming position 10 and waiting positions, so as to switch the image forming units 3.

The image forming units 3 are mounted removably into the machine body 1. When one of the image forming units 3 needs to be replaced, it can easily be replaced with a new unit after rotating the carriage 2 so that the image forming unit 3 to be exchanged is located directly under the top door 17, and opening the door 17.

The color image forming units 3 operate only when they are located at the image forming position 10, where the photoconductive drum 30 is irradiated by the laser beam 8 and in contact with the transfer belt unit 5. In the image forming position 10, the image forming units 3 are connected to a mechanical drive mechanism (which will be detailed later) and a power source of the machine body 1, which perform the image forming operation. All other positions are waiting positions, in which the image forming units 3 do not operate.

The front alligator 1A is hinged to the machine body 1 with a hinge shaft 1B and can be opened to the front. A fuser 15, a secondary transfer roller 9, a discharging needle 7, a front portion of paper guides 13*a*, 13*b*, 13*c*, and 13*d* and a frontal resist roller 16 are attached to the front alligator 1A. These members accompany the front alligator 1A when it opens, so that a large opening appears in the front side of the machine body 1 when the front alligator 1A is opened. Thus, attaching and detaching of the transfer belt unit 5 and removal of jammed paper becomes easier.

The transfer belt unit 5, when mounted properly in the machine body 1, is positioned precisely and a portion of the intermediate transfer belt facing the image forming position 10 has contact with the photoconductive drum of the image forming unit 3. Each portion of the transfer belt unit 5 is connected to the machine body electrically and the driving roller 55A is connected to the driving means of the machine body so that the intermediate transfer belt 50 can rotate.

The discharging needle 7 prevents a toner image on the paper from being distorted when the paper is separated from the intermediate transfer belt 50.

A laser exposing device 6 is provided under the transfer belt unit 5. The laser exposing device 6 comprises a semiconductor laser (not shown in the drawing), a polygon mirror 6A, a lens system 6B, and a first mirror 6C. A laser signal beam 8, which corresponds to a sequential electric pixel signal of image information, passes through a light path 24 between the waste toner reservoir 37 of the yellow image forming unit 3Y and the toner hopper 39 of the black image forming unit 3Bk. The laser beam passes through an exposure opening 22 (see FIG. 2) provided in the cylindrical shaft 21, and enters the mirror 19 that is located inside the cylindrical shaft 21 and directly fixed to the machine body 1. After reflecting from the mirror 19, the laser beam 8 enters the yellow image forming unit 3Y, which is located at the image forming position 10, through an exposure opening 33. Then, the laser beam 8 enters an exposure portion on the left side of the photoconductive drum 30 and scans in the axis direction to expose the photoconductive drum 30.

Numeral 12 denotes a paper feed unit, numeral 14 a paper feed roller and numeral 18 a paper eject roller.

FIGS. 2–8 explain a positioning mechanism and a driving mechanism for precise alignment of all colors in the image forming position.

Figure 2:
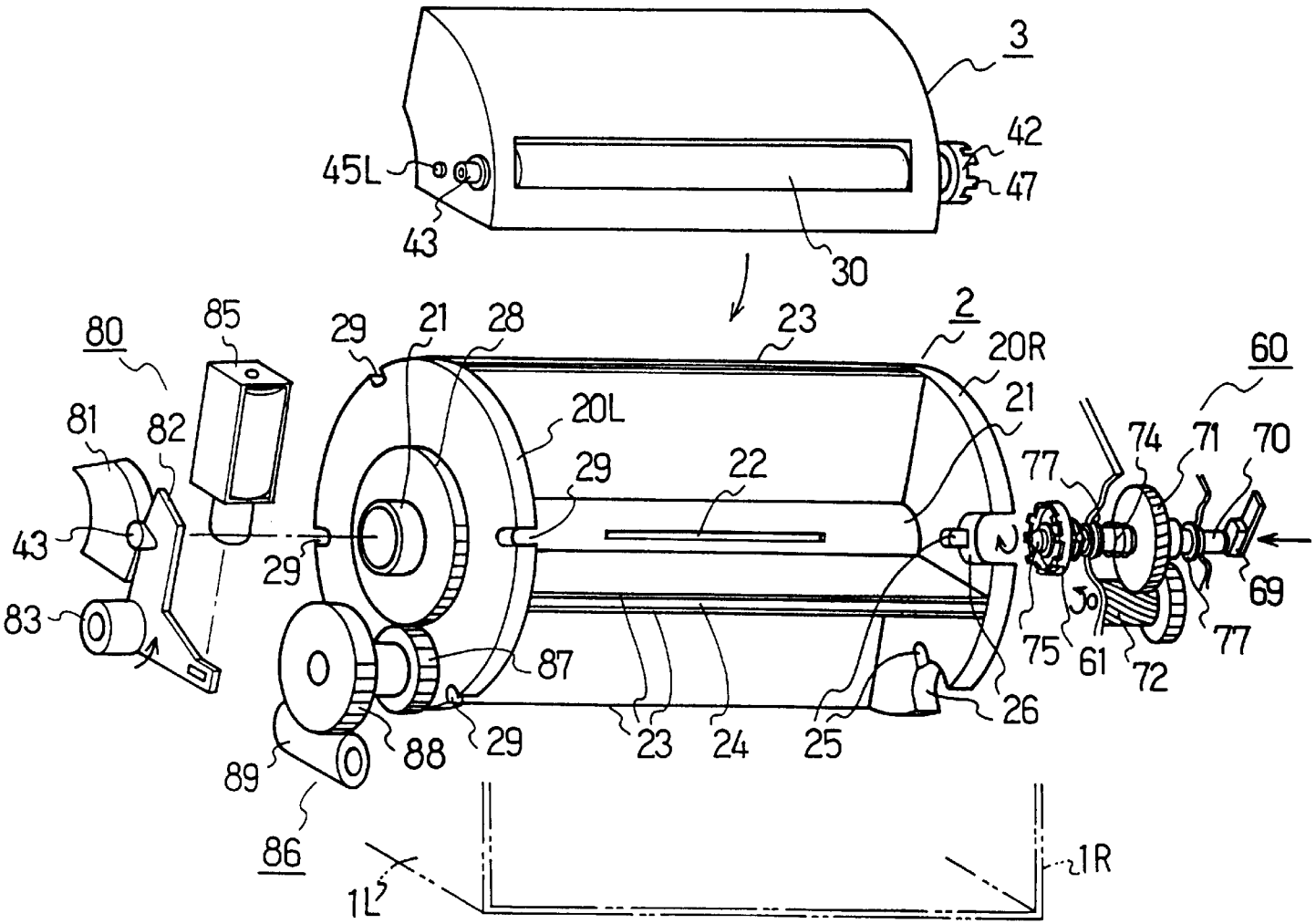
FIG. 2 is a perspective exploded view of a positioning mechanism and a driving mechanism of the carriage and photoconductive drum of the color image forming apparatus according to the first embodiment of the present invention.
Figure 3:
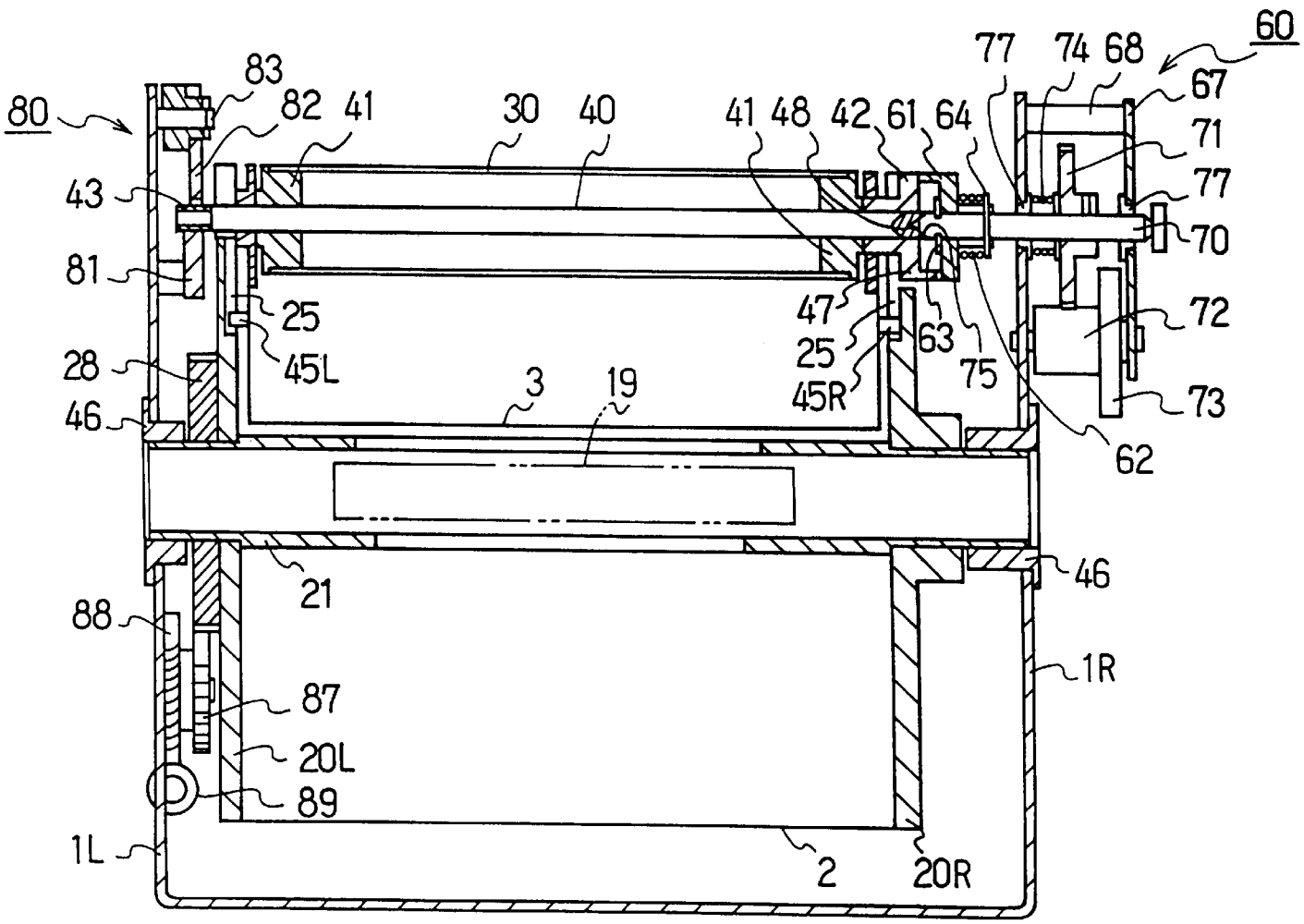
FIG. 3 is a cross section of the color image forming apparatus according to the first embodiment of the present invention, taken on a plane through the carriage that includes the image forming position.
Figure 4:
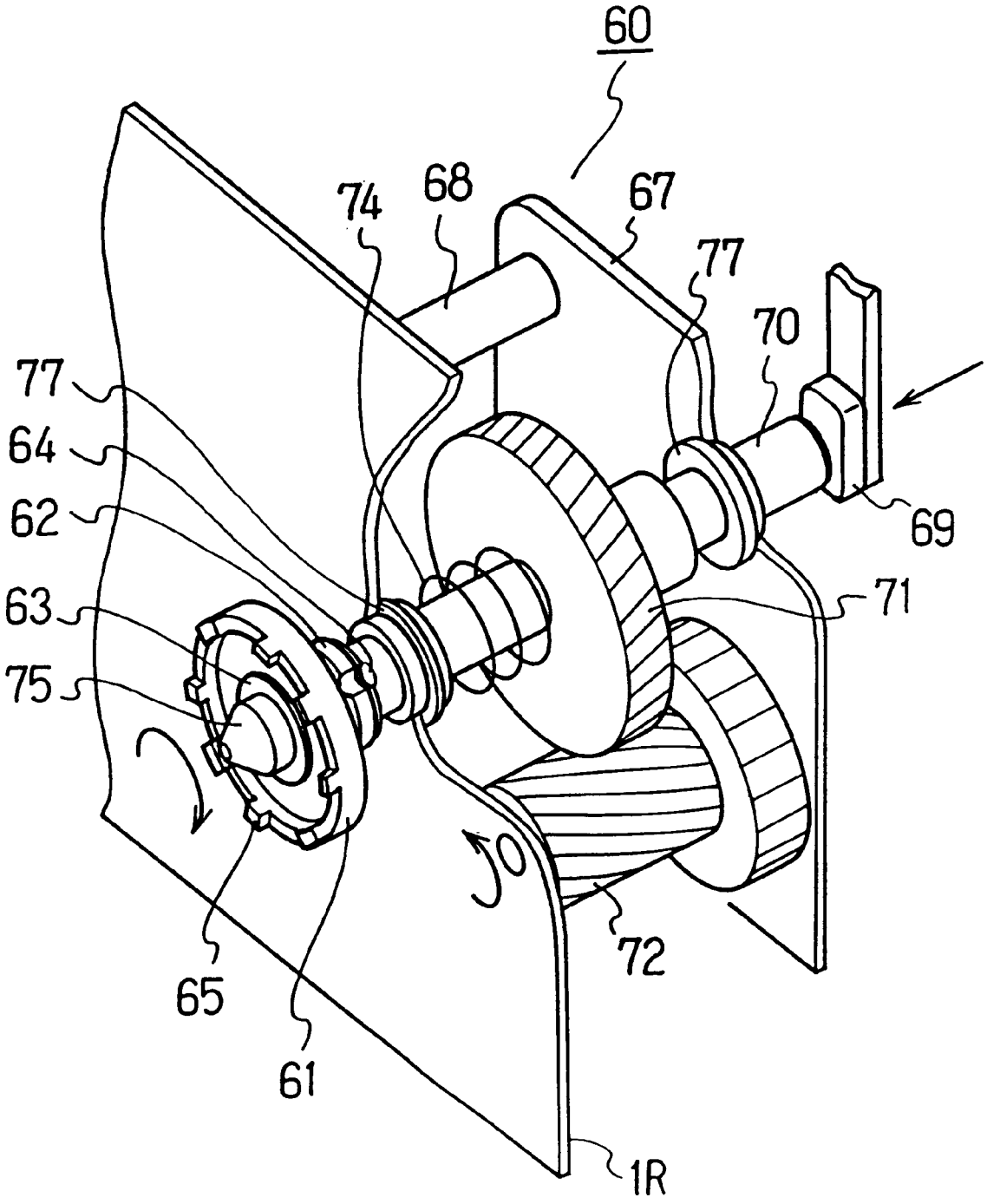
FIG. 4 is a perspective view of a driving mechanism for driving the photoconductive drum located at the image forming position in the color image forming apparatus according to the first embodiment of the present invention.
Figure 5:
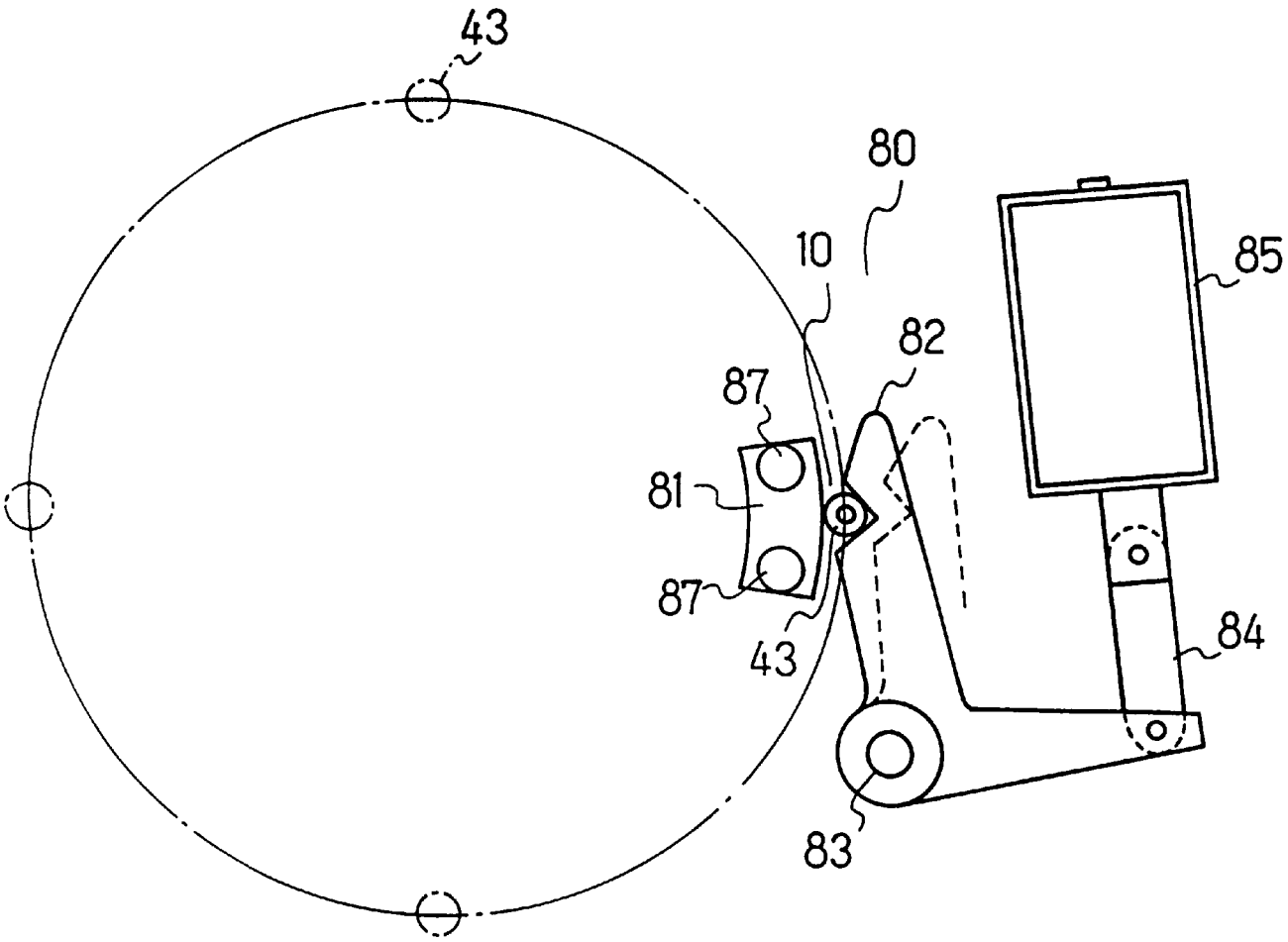
FIG. 5 is a side view of a mechanism for positioning the photoconductive drum shaft of the color image forming apparatus according to the first embodiment of the present invention, at the opposite side of the driving mechanism for the photoconductive drum.
Figure 6:
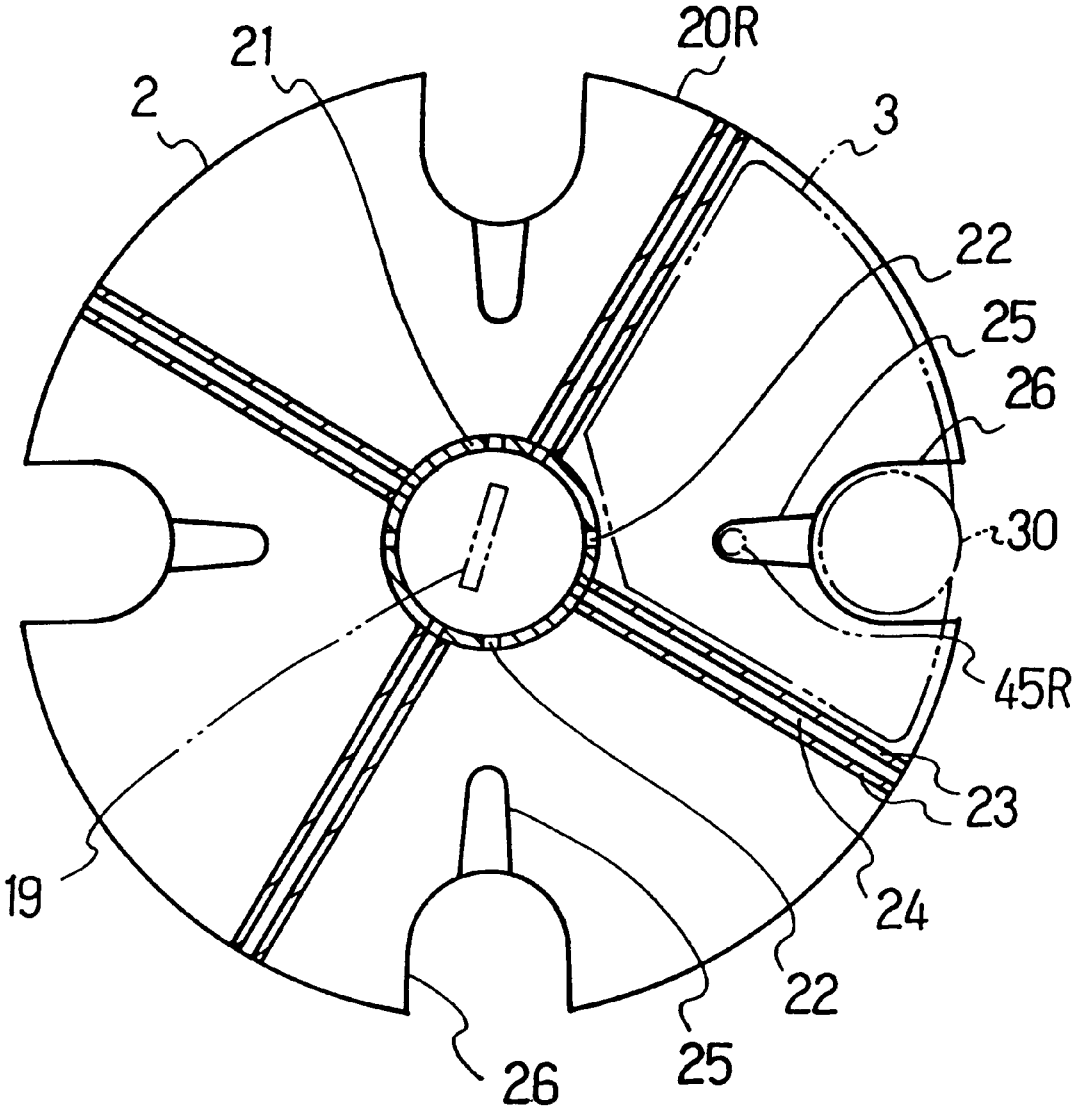
FIG. 6 is a cross section through the center of the carriage of the color image forming apparatus according to the first embodiment of the present invention.
Figure 7:
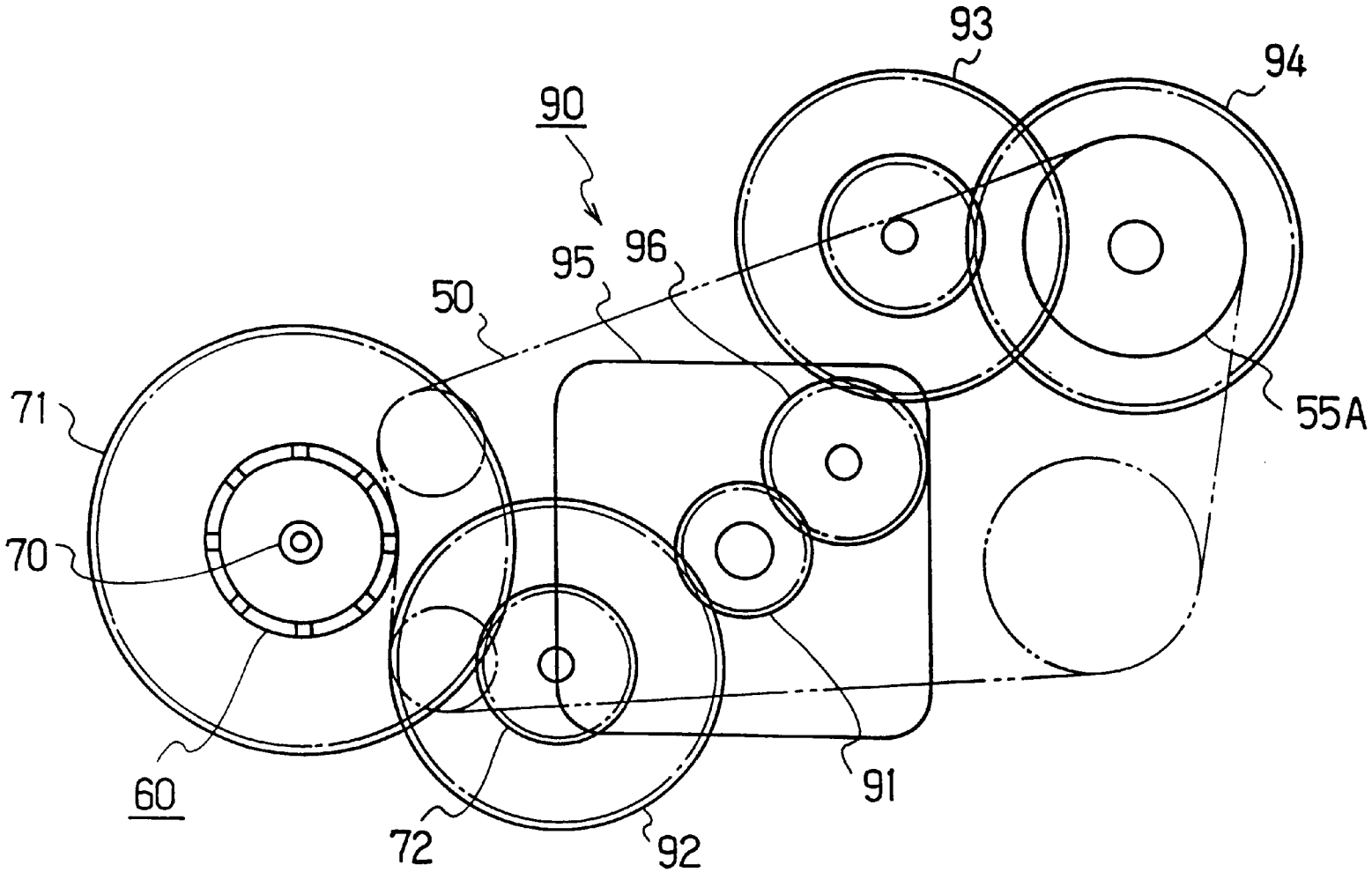
FIG. 7 illustrates the driving mechanism, taken from the side of the machine body, that drives the photoconductive drum and the intermediate transfer belt of the color image forming apparatus according to the first embodiment of the present invention.
Figure 8:
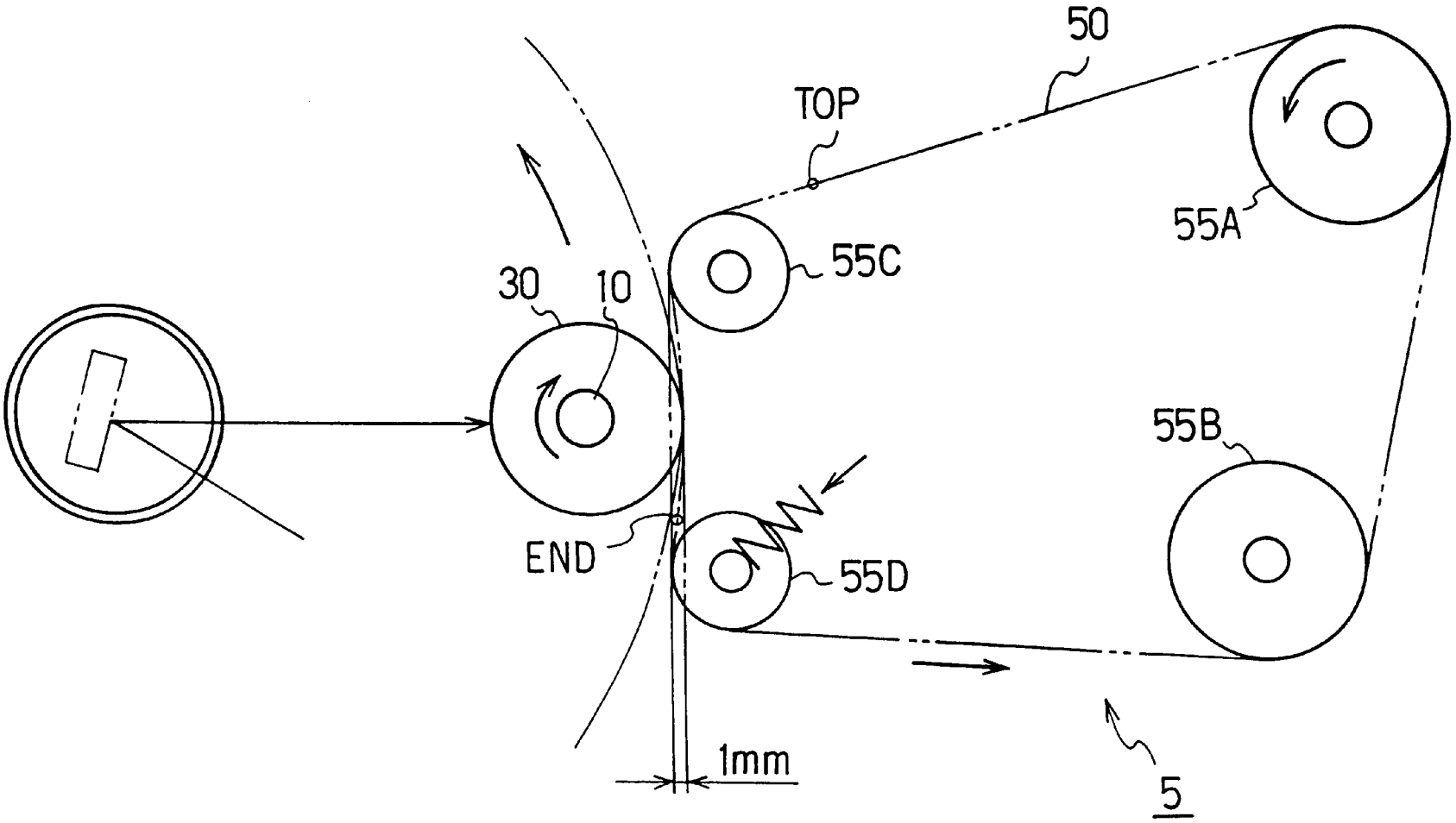
FIG. 8 illustrates the positional relationship between the photoconductive drum and the intermediate belt of the color image forming apparatus according to the first embodiment of the present invention.

FIG. 2 is an exploded perspective view of the positioning mechanism and driving mechanism of the carriage supporting the image forming units and the photoconductive drum of the image forming units. FIG. 3 is a cross-sectional view of the carriage through the plane of the image forming position. FIG. 4 is a perspective view of the driving mechanism driving the photoconductive drum in the image forming position. FIG. 5 is a plan view of a mechanism for positioning the photoconductive drum shaft on the side opposite the driving mechanism. FIG. 6 is a circular cross-section through the center of the carriage. FIG. 7 shows the driving mechanism, taken from the side of the machine body, that drives the photoconductive drum and the intermediate transfer belt. FIG. 8 shows the positional relationship between the photoconductive drum and the intermediate belt.

As can be seen in FIGS. 2 and 3, the carriage 2 has a right wall 20R and a left wall 20L, which are fixed to the central cylindrical shaft 21. Partition plates 23 for partitioning the carriage 2 into four sections are provided at four places between these walls 20R and 20L. An image forming unit 3 for each color is installed in each space partitioned with the partition plates 23. Two partition plates 23 each are fixed in four places in the carriage 2. Between each pair of partition plates 23, a light path 24 is formed, through which the laser beam 8 passes. The cylindrical shaft 21 has a total of eight exposure openings 22, including openings through which the laser beam 8 enters the cylindrical shaft 21, and other openings through which the laser beam 8, which has been reflected by the mirror 19, leaves the cylindrical shaft 21.

A coupling plate 42 is fixed to the photoconductive drum 30 of the image forming unit 3, and right wall 2 are provided on a portion of the right wall 20R for accepting the coupling plate 42. A space is provided between the coupling plate 42 and the right cutout 26, so that the coupling plate 42 and the right wall 20R do not have contact at a regular position. On the outer periphery of the left wall 20L, left cutouts 29 are formed. Each left cutout 29 receives a collar 43 that is provided at the left end of a shaft 40 of the photoconductive drum. A space is provided between the collar 43 and the left cutout 20L, so that the collars 43 and the left wall 20L do not have contact at a regular position.

Guide grooves 25 shown in FIGS. 2 and 6, which are connected to the right cutouts 26 and the left cutouts 29, are formed on the inner side of the right and left walls 20R and 20L. These guide grooves 25 guide the guide pins 45R and 45L provided on both side walls 20R and 20L of the image forming unit 3, which is thus positioned roughly in the carriage 2. When the image forming unit 2 is positioned in the carriage 2, it can pivot on the guide pins 45R and 45L with a clearance between the coupling plate 42 and the right cutouts 26 or with a clearance between the collar 43 and the left cutouts 29, as shown in FIG. 6. In the present example, these clearances are set to about 1 millimeter.

Clearances between the guide pins 45R, 45L and the guide groove 25, and between the outer surface of the image forming unit 3 and all portions of the carriage 2 are provided so that the photoconductive drum 30 can be translated with respect to carriage 2 in every direction, when the photoconductive drum 30 is positioned in the standard image forming position 10. Moreover, protrusions (not shown in the drawing) for preventing the image forming unit 3 from dropping out of the carriage 2 in the radial direction are provided at the outer periphery of the right and left walls 20R and 20L and can be advanced and retracted.

A carriage gear 28 is fixed to the left wall 20L and can be connected to a carriage drive mechanism 86 on the machine body side. This carriage drive mechanism 86 comprises a worm gear 89 connected to a power source (second motor 100 in FIG. 9), a worm wheel 88, and a gear 87 that is integrated with the worm wheel 88 and engages the carriage gear 28.

The carriage 2 is rotatably mounted on the right and left main wall 1R, 1L with bearings 46 so that it is parallel to the laser exposing device 6 and the mirror 19. The mirror 19 is fixed to the right and left main walls 1R, 1L by supporting members (not shown in the drawing).

The photoconductive drum 30 of the image forming unit 3 shown in FIG. 3 comprises a pair of flanges 41, which are rigidly fixed to each end of the photoconductive drum shaft 40. The shaft 40 is rotatably mounted on both side walls of the image forming unit 3. A conical concave surface 48 is formed on the right side of the photoconductive drum shaft 40. The coupling plate 42 is fixed to the photoconductive drum shaft 40 and has eight tongues 47 (see FIG. 2) that are disposed around the conical surface 48. When the coupling plate 42 rotates, the photoconductive drum shaft 40 and the flanges 41 rotate together as one body, so that the photoconductive drum 30 rotates. The collar 43, which serves as a radial bearing, is attached rotatably on the left edge of the photoconductive drum shaft 40.

A driving mechanism 60 and a detent mechanism 80 for positioning the photoconductive drum 30 precisely at the image forming position 10 are employed at the side walls 1R and 1L of the machine body, as shown in FIGS. 2–5.

The driving mechanism 60 of the photoconductive drum 30, which is attached on the right main wall 1R, includes an output shaft 70, a coupling plate 61 that rotates together as one body with the output shaft 70, a driving gear 71 of the output shaft 70, and a power source for driving these elements. The output shaft 70 is supported rotatably and displaceably in the thrust direction by bearings 77 that are fixed between the right main wall 1R and a base plate 67.

The proximal end of the output shaft 70 has a convex tapered tip 75, which has a tapered surface emulating the concave tapered surface of the photoconductive drum shaft 40. The distal end of the output shaft 70 has a spherical shape so as to abut on a thrust bearing 69 with little area. The output shaft driving gear 71, which is fixed to the output shaft 70, is a left-handed helical gear, having the same direction as the rotation direction. This output shaft driving gear 71 engages a gear 72 of the power source side. A compression spring 74 is inserted between the bearing 77 and the output shaft driving gear 71. This compression spring 74 is steadily energized in the position where the output shaft 70 and the coupling plate 61 are separated from the coupling plate 42 of the photoconductive drum 30 (position indicated in FIG. 4). The output shaft 70 can be moved axially against the force of the compression spring 74 by the drive means that moves the thrust bearing 69, between a separated position in FIG. 4 and an engaging position in FIG. 3 where the tapered surface 48 engages the tapered tip 75. The gear 72 of the power source side has a sufficient length in the axial direction so that the output shaft driving gear 71 engages the gear 72 of the power source side in the separated position as well as in the engaging position. When the output shaft 70 is moved along the thrust direction, the output shaft driving gear 71 and the power source gear 72 slide against each other on the tooth faces.

The coupling plate 61 engages the coupling plate 42 of the photoconductive drum 30 for transmission of motive power. The coupling plate 61 has eight coupling tongues 65, as the coupling plate 42, that are disposed on its proximal side. A pin 64 impedes rotation of the coupling plate 61 with respect to the output shaft 70, but the coupling plate 61 is movable in thrust direction within a predetermined distance. Thus, the coupling plate 61 retreats temporarily when the tips of the coupling tongues 65 abut the tips of the coupling tongues 47 of the coupling plate 42, and does not impede the engagement of the tapered surfaces. The coupling plate 61 and is forced by the compression spring 62 to abut a stopper 63.

Next, the detent mechanism 80, which is attached to the left main wall 1L, is explained with reference to FIGS. 2 and 5.

The detent mechanism 80 comprises a guide plate 81, a detent lever 82, and a solenoid 85 for driving the detent lever 82. The guide plate 81, which is fixed to the left main wall 1L, guides the collar 43 placed at the left end of the photoconductive drum shaft 40 to position the collar 43 at a proper radial distance from the center of the carriage 2 when the photoconductive drum is located near the image forming position 10. The detent lever 82 is pivoted on the left main wall 1L by a pivot pin 83 and pushes the collar 43 to the guide plate 81 with a frontal V-groove so as to position the collar 43 correctly for the image forming position 10. The detent lever 82 is connected to the solenoid 85 via a lever 84. The solenoid actuates the detent lever 82 by magnetic force and the V-groove of the detent lever 82 forces the collar 43 to abut the guide plate 81.

The output shaft 70 of the photoconductive drum driving mechanism 60 and the center of the V-groove of the detent mechanism 80 are precisely parallel to the laser exposing device 6 and the mirror 19. For this reason, play of the bearings is minimized, so that the image forming unit 30 is usually located precisely at the image forming position 10 when the photoconductive drum driving mechanism 60 and the detent mechanism 80 are actuated.

The following is an explanation of a driving mechanism for the photoconductive drum 30 and the intermediate transfer belt 50.

As shown in FIG. 7, a driving mechanism 90 for the photoconductive drum 30 and the intermediate transfer belt 50 includes a first motor 95 as a power source and slowdown gears 92, 93 that are connected to that first motor 95. The slowdown gear 92 is identical with the power source gear 72 in FIG. 4. A dc servo motor is used as the first motor 95. The first motor 95 is the exclusive power source for the photoconductive drum 30 and the intermediate transfer belt 50, so as to suppress load changes for the first motor completely.

When the transfer belt unit 5 is installed, the slowdown gear 93 engages a roller gear 94, which is fixed to the drive roller 55A. The slowdown gear 92 engages the output shaft drive gear 71 to rotate the photoconductive drum 30 (see FIGS. 2 and 4). A motor gear 91 engages the slowdown gear 92 and an idler gear 96. The rotation ratios of these gears, per rotation of the intermediate transfer belt, are all integers. An outer diameter of the drive roller 55A is about 30 mm and a perimeter of the intermediate transfer belt is about 377 mm. Four turns of the drive roller 55A corresponds to precisely one turn of the intermediate transfer belt 50. The rotation ratio of the roller gear 94 to the slowdown gear 93 is 1:4.5. The rotation ratio of the roller gear 94 to the idler gear 96 is 1:18. The rotation ratio of the roller gear 94 to the motor gear 91 is 1:18. The rotation ratio of the roller gear 94 to the output shaft driving gear 71 is 1:1, and the rotation ratio of the output shaft driving gear 71 to the slowdown gear 92 is 1:4.5.

FIG. 8 explains the relationship between the photoconductive drum in the image forming position and the intermediate transfer belt. In FIG. 8, positioning means (not shown in the drawing) position the transfer belt unit 5 between the right and left walls 1R, 1L of the machine body 1. The perimeter of the photoconductive drum 30 located at the image forming position 10 crosses the tangent line of the guide roller 55C and the tension roller 55D by about one millimeter, and bulges into the belt side. Therefore, the tension of the intermediate transfer belt 50 presses the intermediate transfer belt 50 constantly against the peripheral surface of the photoconductive drum 30. Thus, uniform contact between the intermediate transfer belt 50 and the photoconductive drum 30 is obtained.

Figure 9:
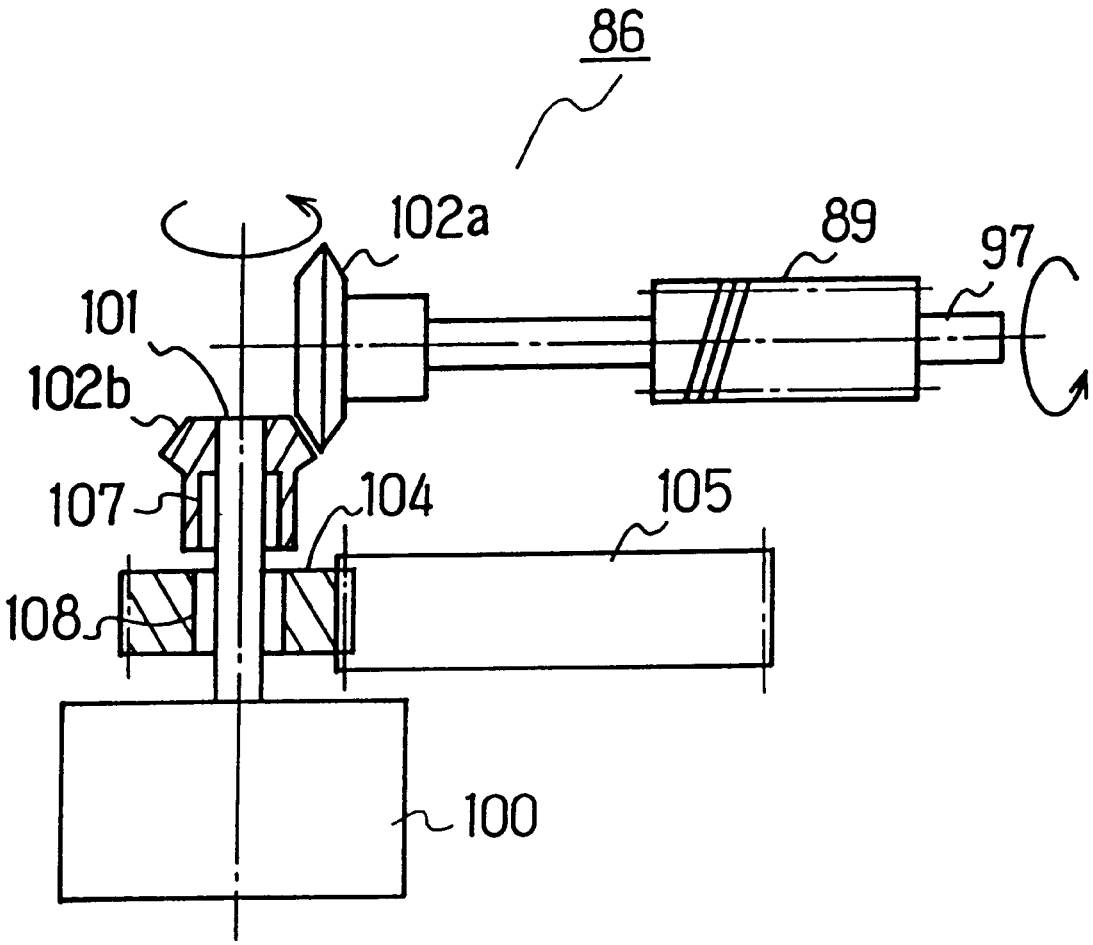
FIG. 9 is a diagram illustrating the carriage driving mechanism for rotating the carriage of the color image forming apparatus according to the first embodiment of the present invention.

FIG. 9 shows the carriage driving mechanism rotating the carriage. A worm gear 89 engages a worm wheel 88 (see FIG. 2). The worm gear 89 is coupled to a bevel gear 102*a* via a shaft 97. The bevel gear 102*a* engages bevel gear 102*b* and is connected to a second motor 100 via a one-way clutch 107. This one-way clutch 107 transmits only right rotations of the second motor 100. For left rotations of the second motor 100, the motor shaft 101 and the one-way clutch idle, so that no rotation is transmitted. A switching gear 104 is connected to the motor shaft 101 via a one-way clutch 108 that transmits only rotations opposite to those transmitted by the one-way clutch 107. The switching gear 104 is connected to a gear 105, which is connected to the fuser 15, the paper feed and paper eject roller group and the developing device 35 in the image forming position 10. Therefore, the secondary motor 100 rotates the carriage 2 when turning right and rotates the fuser 15, the paper feed and paper eject roller group and the developing device 35 in the image forming position 10 when turning left. A step motor is used for the second motor 100. When the image forming unit 3 is changed, the second motor 100 is controlled by an open loop, and accelerated/decelerated/stopped in a predetermined number of steps.

Operation of the Apparatus

The following is an explanation of the color image forming process.

When the transfer belt unit 5 and all image forming units 3 are installed in their predetermined locations, the power for the machine 1 is turned on, the fuser 15 is heated up, the polygon mirror 6A of the laser exposing device 6 starts to revolve, and thus the preparations are completed.

After these preparations, first, an initialization operation can be run to move the image forming unit 3 of the color to be recorded to the image forming position. In this case, the second motor 100 begins to turn right, and the rotational power of the second motor 100 is transmitted to the carriage 2 via the one-way clutch 107. At this stage, the switching gear 104 and the gear 105 do not operate. Then, when the image forming unit 3 of the color to be recorded first (in the present embodiment the yellow image forming unit 3Y) approaches the image forming position 10, the second motor 100 for driving the carriage stops, the worm gear 89 stops, and the carriage 2 locks in this position.

When the carriage 2 rotates, the output shaft 70 of the photoconductive drum driving mechanism 60 retreats due to the energization of the compression spring 74, and the tapered tip 75 and the coupling plate 61 are in a position separated from the coupling plate 42 of the photoconductive drum 30. The solenoid 85 of the detent mechanism 80 is turned off and the detent lever 82 is in the stand-by condition indicated by a broken line in FIG. 5. In this situation, the first motor 95 driving the photoconductive drum 30 and the intermediate transfer belt 50 is standing still.

When the carriage 2 stops, the solenoid 85 of the detent mechanism 80 is immediately turned on, so that the detent lever 82 forces the collar 43 of the photoconductive drum shaft 40 to abut the guide plate 81. A specified position is assumed while holding the collar 43 with the V-groove of the detent lever 82.

Simultaneously, the thrust bearing 69 pushes the output shaft 70 to the left in FIG. 3. The tapered tip 75 of the output shaft 70 starts to engage the tapered surface 48 of the photoconductive drum shaft 40 and proceeds while shifting the photoconductive drum shaft 40 to the center of the output shaft 70. When the thrust bearing 69 pushes the output shaft 70 further, the tapered tip 75 engages the tapered surface 48, and the center of the photoconductive drum shaft 40 aligns perfectly with the center of the output shaft 70. Thus, the photoconductive drum 30 is positioned precisely in the image forming position 10. In this situation, the thrust from the output shaft 70 pushes the end of the flange 41 against the side wall bearings, and abuts on the left side wall 20L of the carriage 2. Furthermore, when the tapered tip 75 engages the concave tapered surface 48, the coupling plates 42 and 61 engage each other, so that a rotational force can be transmitted between the two.

As mentioned above, the yellow photoconductive drum 30 is positioned correctly by the detent mechanism 80 and the drive mechanism 60. Then, the image forming unit 3Y, which includes the photoconductive drum 30, is moved with the photoconductive drum 30 in the carriage 2. However, since the image forming unit 3 is retained in the carriage 2 with some clearance, the carriage 2 does not hinder the movement of the image forming unit 3 for positioning. Although the carriage 2 has some clearance in the rotation direction such as a backlash between a spur gear 28 and the gear 87, this does not effect the precise positioning of the photoconductive drum 30, since the photoconductive drum 30 is positioned by the positioning mechanism of the machine body.

After the positioning of the photoconductive drum 30 is completed, the first motor 95 for driving the photoconductive drum 30 and the belt starts to rotate photoconductive drum 30Y and the intermediate transfer belt. The drive roller 55A is driven and its friction force lets the intermediate transfer belt rotate in the arrow direction in FIG. 8. In this situation, the peripheral speed of the photoconductive drum 30 and the peripheral speed of the intermediate transfer belt 50 are almost the same. The secondary transfer roller 9 and the cleaner 51 are separated from the intermediate transfer belt 50.

At the same time as the start of the first motor 95, the second motor 100 starts to rotate left, and, via the one-way clutch 108, the rotation of the second motor 100 causes the switching gear 104 and the gear 105 and drives the fuser 15, the paper feed, the eject roller group, and the developing device 35 located in the image forming position. The developing roller 35*a* presses on the photoconductive drum 30 and its contact surface rotates with 1.6 times the peripheral velocity of the photoconductive drum 30 in the same direction as the photoconductive drum 30. Since a conventional gear transmission system is appropriate as the transmission mechanism from the gear 105 onward, its explanation is omitted. The carriage 2 is still at rest, because the second motor 100 turns left. The motor shaft 101 and the gear 102*b* are idling, and since the worm gear 89 and the worm wheel 88 are part of the transmission system to the carriage 2, the carriage 2 is usually locked.

At the same time when the motors 95 and 100 start to rotate, each process element starts to operate. Then, after the position of the intermediate transfer belt has been detected, a laser beam 8 is irradiated from the laser exposing device 6 in accordance with an image signal. When the laser beam 8 is irradiated on the evenly charged photoconductive drum 30, a static latent image is formed according to the image signal. This static latent image is subsequently made manifest by the developing device 35, and a toner image is formed. Then, the toner image formed on the photoconductive drum 30 is moved to a primary transfer position contacting the intermediate transfer belt 50 and subsequently copied from there onto the intermediate transfer belt 50.

To precisely match the start positions of the images formed on the intermediate transfer belt 50, the image start position on the intermediate transfer belt 50 is detected by adjusting the position of the position detect holes to a sensor after the first motor 95 has been started and reached a certain constant speed. On the intermediate transfer belt, an inlet length of about 15 mm is necessary until the first motor 95 reaches a certain constant speed.

The following explains the time course from the start of the first motor 95 to the beginning of the exposure. First, the first motor 95 is started and reaches a constant velocity (Operation 1). Then, the position detect holes in the intermediate transfer belt 50 proceed to a sensor where they are detected (Operation 2), and the exposure begins after a certain time span has lapsed (Operation 3). During these operations, the intermediate transfer belt 50 proceeds about 15 mm for Operation 1, about 10 mm for Operation 2 and about 1 mm for Operation 3. Consequently, the leeway from the point where the first motor 95 reaches a constant speed until the position of the intermediate transfer belt 50 is detected is about 10 mm.

At the time of image formation, the charger 34 charges the photoconductive drum 30 at −450V. The exposing potential of the photoconductive drum is −50 volts. DC voltage of +100V is applied from a high-voltage source to the developing roller 35*a* when it passes a region of the photoconductive drum 30 that is not yet charged. Then, when the surface of the photoconductive drum 30, into which a static latent image has been inscribed, passes the developing roller, a DC potential of −200V is applied from a high-voltage source to the developing roller 35*a*. A DC voltage of +1.0 kV is applied to the guide roller 55C and the tension roller 55D of the intermediate transfer belt 50.

During this image forming operation, the output shaft 70 is still pushed by the thrust bearing 69 to the left, and the solenoid 85 is still actuated, so that the detent lever retains the collar 43.

When the end of the image has been copied onto the intermediate transfer belt 50, the yellow image formation is finished, and the photoconductive drum 30 and the intermediate transfer belt 50 stop in an initialization position. Then, the intermediate transfer belt 50 performs one full rotation (while the photoconductive drum and the drive roller 55A rotate four times and the guide roller 55C rotates six times) and returns to the initialization position.

When the recording of the first color is finished, the first motor 95 and the second motor 100 stop and thus the photoconductive drum 30, the intermediate transfer belt 50, the fuser 15, the paper feed, the paper eject roller group, and the developing device 35 located at the image forming position all stop. After this, the solenoid 85 is turned off, thus releasing the detent lever 82. Simultaneously, the thrust bearing retreats to the right. The driving shaft 70 is withdrawn to the right by the bias force of the compression spring 74, and the coupling plate 61 and the tapered tip 75 are separated from the coupling plate 42 and the photoconductive drum shaft 40. Thus, the positioning of the photoconductive drum 30 is released and it becomes possible to rotate the carriage 2.

When the coupling between the photoconductive drum shaft 40 and the output shaft 70 is released, the second motor 100 again starts to rotate right, so that the worm gear 89 is again rotated. The carriage 2 rotates in the direction indicated by an arrow in FIG. 1 and stops when the magenta image forming unit 3M for performing the next image formation has approached the image forming position 10.

When the carriage 2 is rotated to switch the image forming unit 3, the photoconductive drum 30 is brought in and out of position while rubbing along the intermediate transfer belt 50, as shown in FIG. 8. This rubbing length is about 10 mm each for bringing the photoconductive drum 30 in or out of the image forming position 10, which adds up to a total of about 20 mm. The intermediate transfer belt 50 makes one full rotation for the recording of each color and usually stops at a certain position when colors are switched, so that between an image top (TOP) and an image end (END) no image is formed and the image is not corrupted when the image forming unit 3 is switched.

The image end (END) stops at a position that is about 15 mm downstream from the transfer position (downstream meaning here in rotation direction of the intermediate transfer belt 50), which is longer the rubbing length (about 10 mm) for entering and leaving the transfer position, so that the image is not corrupted by rubbing with the photoconductive drum 30 at the time of color changing.

Then, the detent mechanism 80 and the photoconductive drum driving mechanism are activated again, and the magenta photoconductive drum 30 is positioned. After this, the photoconductive drum shaft 40 and the output shaft 70 are coupled and the image forming operation for magenta begins. As a result, a yellow and a magenta toner image are formed and superimposed on the intermediate transfer belt 50.

A similar sequential switching operation and image forming operation is repeated for cyan and black, so that four toner images are formed on the intermediate transfer belt 50.

After the black image has been transferred onto the intermediate transfer belt 50, the secondary transfer roller 9 contacts the intermediate transfer belt 50 until image top (TOP) comes to the position of the secondary transfer roller 9. Then, the four-color toner image is transferred in one batch onto recording paper, which is fed from the paper feed unit 12. During this time, a voltage of +300V is applied to the secondary transfer roller 9. The toner image is fused on the recording paper by passing a fuser 15, and the recording paper is ejected out of the apparatus with the paper eject roller 18.

Any toner that remains on the intermediate transfer belt 50 after the secondary transfer is scraped off with the cleaning blade 53, which contacts the intermediate transfer belt 50 until the image top (TOP) comes in into the cleaning position.

When the secondary transfer is finished, the intermediate transfer belt 50 and the image forming unit 3 stop again, and the carriage 2 rotates 90 degrees. Then, the yellow image forming unit 3Y arrives at the image forming position 10, and the next color image forming operation can begin. The secondary transfer and the cleaning can be performed during the last recording of black, or after the recording of black.

In the present embodiment, a 90 degree rotation of the carriage 2 takes 0.6 sec, the attach and the detach operation for coupling and decoupling the output shaft 70 take 0.2 sec each, and the process speed is about 100 mm/sec.

Color Positioning

The following is an explanation of the positioning for each color according to the present invention.

It is important that both of the photoconductive drum 30 and the intermediate transfer belt 50 rotate accurately at a constant speed in order to ensure precise positioning of the color images.

In the present embodiment, a DC servo motor with excellent constant-speed control is used as the first motor 95 for driving the photoconductive drum 30 and the intermediate transfer belt 50. Moreover, to suppress load variations, the first motor 95 is used exclusively for the purpose of driving the photoconductive drum 30 and the intermediate transfer belt 50, so that load variations in the driving system can be suppressed.

The recording of each color is performed after the first motor 95 is started, that is, when the first motor 95 has reached a perfectly constant speed, and the image start position on the intermediate transfer belt 50 has been detected steadily and precisely.

It is also necessary that the positioning of the four photoconductive drums 30 at the image forming position 10 is accurate with high repeatability to ensure precise positioning. As mentioned before, positioning of the photoconductive drum 30 in this embodiment is performed by the output shaft 70 and the detent lever 82, which are attached to the right and left walls 1R, 1L and support the photoconductive drum shaft. The photoconductive drum 30 is pivoted movably within a predetermined clearance in the carriage 2, so that the carriage 2 only has to be positioned roughly, and the photoconductive drum 30 can be positioned precisely and with high repeatability, independently from the positioning accuracy of the carriage 2.

Figure 15:
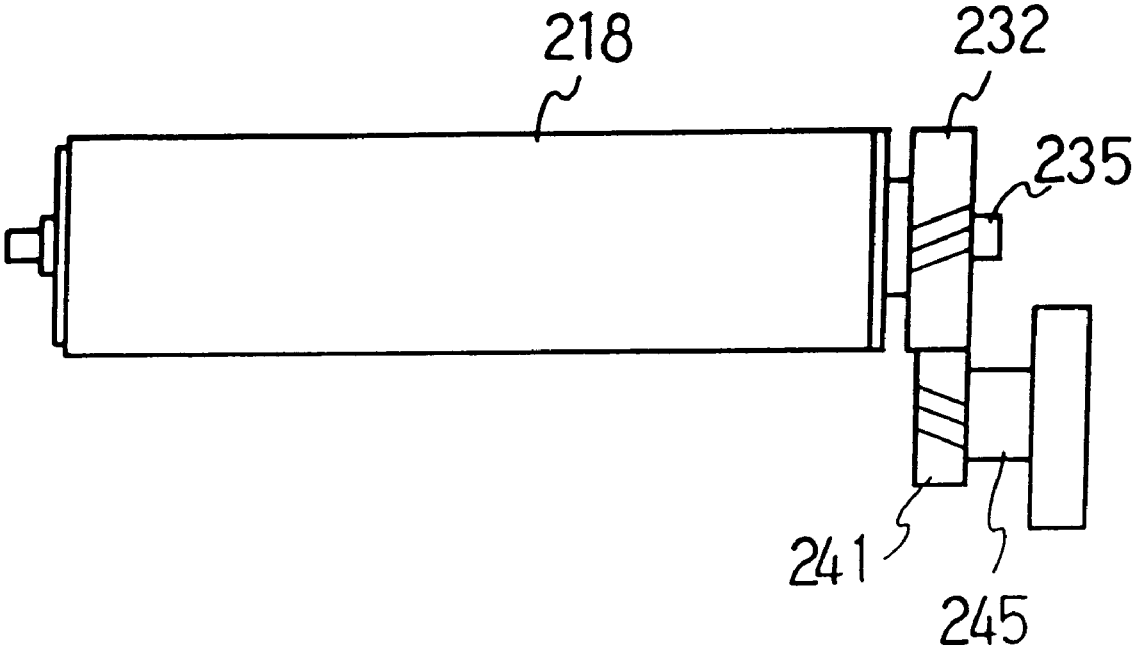
FIG. 15 PRIOR ART
FIG. 15 is a diagram showing a conventional coupling portion for coupling the photoconductive drum and the output shaft of a color image forming apparatus.

It is also necessary to rotate the precisely positioned photoconductive drum 30 with preciseness. In order to change the photoconductive drum 30, some kind of means for engaging and interrupting the driving mechanism has to be provided between the photoconductive drum 30 and the driving mechanism on the machine body. When this means for engaging and interrupting the driving mechanism consists of conventional gears, as shown in FIG. 15, characteristic variations in the transmission of the angular velocity can occur for each photoconductive drum 30, and a positional misalignment occurs. Especially, since the four photoconductive drums 30 are not used indefinitely, but are exchanged when the toner is all used up, variations in the precision of the photoconductive drum 30 can occur easily, and the coupling mechanism is easily affected by the precision of the photoconductive drum 30.

In the present embodiment however, with the configuration explained above, the photoconductive drum 30 is rotated while being held, axis by axis, by the output shaft 70, so that the output shaft 70 and the photoconductive drum 30 are rotated together in the same direction and at the same angular velocity. Consequently, variations in the angular velocity transmitted between the output shaft 70 and the photoconductive drum 30 cannot occur, and the angular velocity is transmitted precisely from the output shaft 70 to the photoconductive drum 30. Therefore, the photoconductive drum rotates with exactly the same angular velocity and it is not required to use coupling members for the photoconductive drum 30 that have precise dimensions.

When the photoconductive drum 30 has portions that are eccentric with respect to the center of the conical concave surface 48, which is the rotational center of the photoconductive drum 30, this leads to a variation of the peripheral velocity of the photoconductive drum 30. Consequently, the recording pitch on the circumference of the photoconductive drum 30 changes. When images are superimposed on the intermediate transfer belt 50 while the recording pitch on the photoconductive drum 30 varies, position misalignment of the colors occurs.

On the other hand, in the present embodiment, the intermediate transfer belt 50 is pressed lightly against the photoconductive drum 30 by its own tensile force, as has been explained above, and is driven at a constant speed, regardless of the outer peripheral velocity of the photoconductive drum 30. With this structure, when the outer peripheral velocity of the photoconductive drum 30 changes due to eccentricity, slippage occurs between the photoconductive drum 30 and the intermediate transfer belt 50. Therefore, the portion that has been recorded with an elongated recording pitch because of high outer peripheral velocity of the photoconductive drum 30 is transferred onto the intermediate transfer belt 50 with compression, and in the reverse case with elongation, so that variations in the recording pitch can be corrected. As a result, the recording pitch corresponding to the angular velocity can be transferred precisely, regardless of the outer peripheral speed of the photoconductive drum 30.

The preciseness of the photoconductive drum 30 (i.e. preciseness of diameter, circularity, straightness, etc.) and the preciseness of the coupling members, flanges, etc. can be considered in terms of eccentricities in the outer perimeter of the photoconductive drum 30 against the output shaft 70.

In the transmission system from the first motor 95 to the output shaft 70 or the intermediate transfer belt 50, a variation of the angular velocity occurs on the main body side due to eccentric components of the gear difference. To even this out, in the present embodiment, the rotation ratio of all gears of the driving mechanism 90 and the rotation ratios of the driving roller 55A and the guide roller 55C, per rotation of the intermediate transfer belt 50, are all set to integers. Due to this structure, these elements usually return to the same initialization position after one color has been recorded, so that recording can be repeated under the same conditions. Therefore, variations from the ideal position can occur even when each color is driven ideally at the same velocity, but this variation pattern has a constant phase for each color, so that recording positions on the intermediate transfer belt 50 match perfectly for each color and position misalignment is eliminated.

According to the present embodiment, the coupling plate 42, which is fixed to the photoconductive drum 30, rotates together as one body with the coupling plate 61 on the main body side at the same angular velocity and in the same direction, and the intermediate transfer belt 50 is driven at a constant velocity. Thus, an image can be recorded without positional misalignment, even when a plurality of photoconductive drums 30 are switched for this purpose.

Moreover, the rotation ratios of the output shaft 70 and the driving roller 55A, per rotation of the intermediate transfer belt 50, are integers, so that the difference between the angular velocity of the photoconductive drum 30 and the peripheral velocity of the intermediate transfer belt 50, which arises from the driving mechanism 90 on the main body side regardless of each photoconductive drum 30, can be synchronized for each color. Therefore, an image can be recorded with high precision and without positional misalignment, even when a plurality of photoconductive drums 30 with fluctuations in the dimensional accuracy are used.

It is preferable that the rotation ratios of the driving roller 55A, the photoconductive drum 30 and the gears of the driving mechanism 90, per rotation of the intermediate transfer belt 50, are integers precisely. However, the present invention can also be implemented when these ratios are not precisely integers. Even when they are not integers, the positional misalignment of the colors is small and the image quality is not harmed, as long as the misalignment of the rotational phase of the driving roller 55A and the photoconductive drum 30 against the image start position on the intermediate transfer belt 50 during the formation of one image is not more than 45 degrees, preferably not more than 30 degrees.

Moreover, it is preferable that all the gears of the driving mechanism 90 have rotation ratios, per rotation of the driving roller 55A, that are integers. However, the present invention can also be implemented when not all rotation ratios of the gears, per rotation of the driving roller 55A, are integers, if their rotation ratios, per rotation of the driving roller 55A, are not more than 4:1. When their rotation ratios, per rotation of the driving roller 55A, are not more than 4:1, the positional misalignment of the colors is small and the image quality is not harmed.

In the present embodiment, tongues are provided as coupling members on the plates of both main body side and photoconductive drum side. However, the present invention is not limited to such a structure. For example, it is possible to attain the same effect by using a pin shape for the coupling member of the output shaft 70, as shown in FIG. 10.

Figure 10:
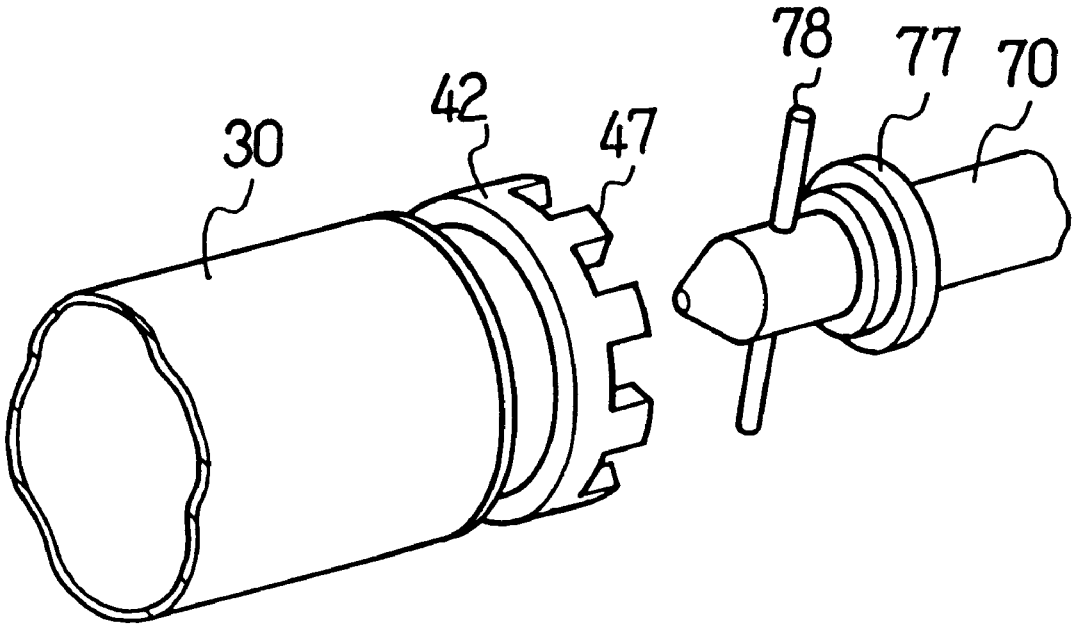
FIG. 10 is a perspective view of another example of the coupling portion of the color image forming apparatus according to the first embodiment of the present invention.

In FIG. 10, a coupling pin 78, which is used instead of the coupling plate 61 shown in FIG. 4, is fixed to the output shaft 70. When the tapered tip 75 engages the tapered surface 48 of the photoconductive drum 30, this coupling pin 78 enters the grooves between the tongues 47 of the coupling plate 42 for the photoconductive drum 30, thus engaging the coupling plate 42 so that the photoconductive drum 30 can be rotated. The structure according to FIG. 10 matches the axial center of the output shaft 70 to the rotational center of the photoconductive drum 30. It rotates the photoconductive drum 30 while supporting it with the output shaft 70, and thus encompasses sufficient functionality in a simple coupling structure.

The present embodiment uses gears for the slow-down from the first motor 95 to the driving roller 55A and the output shaft driving gear 71. However, the present invention is not limited to this structure and a belt or rollers etc. can also be used for the slow-down. In that case, the same effect as in the present embodiment can be attained when the rotation ratios among the rotating members are integers.

Moreover, the present embodiment uses an intermediate transfer belt 50 as the transferring member for receiving and transferring a superimposed toner image from the photoconductive drums 30, and favorable results are attained when pressure and friction between the intermediate transfer belt 50 and the photoconductive drum 30 are kept small. However, the present invention is not limited to this structure. For example, an intermediate transfer drum or a structure where the recording paper is wrapped around a drum can be used as well when the transfer device and the photoconductive drum are driven at a constant speed, irrespective of their mutual peripheral velocity, and fluctuations in the accuracy of the outline of the photoconductive drums are corrected by introducing slippage between the transfer device and the photoconductive drum. In that case, it is preferable that the photoconductive drum contacts the transfer device lightly or not at all.

The present invention is not limited to the coupling portions for precisely transmitting angular velocity that are explained for the present embodiment. For example, it is also possible to position and fix the photoconductive drum shaft 40 as a positioning shaft that does not rotate the output shaft 70, and rotate a coupling plate 61 arranged around the output shaft 70, which rotates a coupling plate 42 around the photoconductive drum shaft 40.

Second Embodiment

Figure 11:
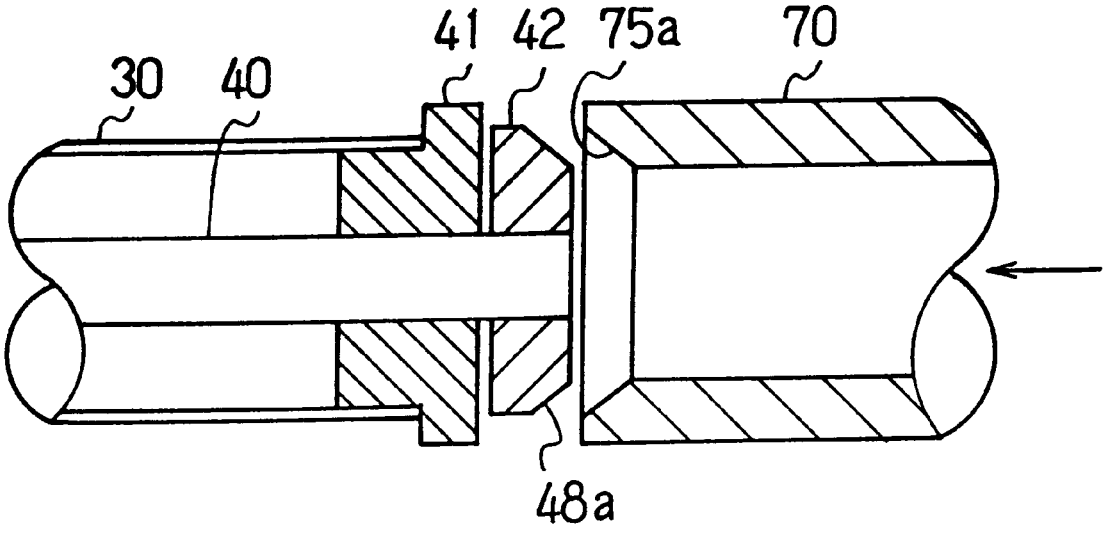
FIG. 11 is a cross section showing the coupling portion of the color image forming apparatus according to a second embodiment of the present invention.

FIG. 11 is a cross-sectional view of a coupling portion in a second embodiment of the color image forming apparatus according to the present invention.

In this embodiment, the output shaft 70 drives the photoconductive drum 30, exactly as in the above first embodiment, but the structure of the coupling portion is different.

As shown in FIG. 11, the output shaft 70 is of cylindrical shape, and a concave tapered surface 75 is formed in its tip. A coupling plate 42, which has a convex tapered surface 48*a* formed on its front perimeter, is fastened to the tip of the photoconductive drum shaft 40. Thus, when the output shaft 70 is thrust out in the arrow direction, the tapered surface 75*a* of the output shaft 70 engages the tapered surface 48*a* of the photoconductive drum shaft 40, so that the axial center of the output shaft 70 matches that of the photoconductive drum shaft 40. In this position, the tapered surfaces 75*a* and 48*a* push onto each other, and rotational force is transmitted by friction between the tapered surface 75*a* and the tapered surface 48*a*.

In the coupling portion of this embodiment, as in the coupling portion of the first embodiment, the center of the output shaft 70 matches the center of the photoconductive drum shaft 40, and the photoconductive drum 30 is rotated by this output shaft 70. Therefore, and in contrast to conventional coupling methods using e.g. gears where the center of the photoconductive drum 218 is in an entirely different position from the center of the output shaft 245 (see FIG. 15), the angular velocity of the output shaft 70 can be correctly transmitted to the photoconductive drum 30.

Moreover, in the present embodiment the driving force is transmitted using friction between the tapered surface 75*a* of the output shaft 70 and the tapered surface 48*a* of the photoconductive drum shaft 40. Thus, in contrast to the structure of the first embodiment as shown in FIG. 4, a collision between the convex tongues is ruled out. Therefore, it is not necessary to provide play over which the coupling plate can be moved relative to the output shaft 70. Moreover, the output shaft 70 and the coupling portion can be integrated into one component, which simplifies the structure of the output shaft 70.

When the convex tongues in FIG. 4 abut each other, no driving force is transmitted until the convex tongues of the coupling plate 61 engage the concave portions between the tongues of the opposing coupling plate 42. However, in the case of the present embodiment, a driving force can be transmitted steadily as soon as the coupling members press onto each other, because friction force between the tapered surface 75*a* of the output shaft 70 and the tapered surface 48*a* of the photoconductive drum shaft 40 is used to transmit the driving force.

Moreover, since in the present embodiment the driving force is transmitted on a peripheral portion a large torque can be attained with little friction. Therefore, the angular velocity can be transmitted precisely and steadily.

The present embodiment uses the friction force on the peripheral tapered surfaces to transmit the driving force. However, the present invention is not necessarily limited to this structure. For example, the structure of the output shaft 70 can also be simplified by providing convex and concave tongues engaging into each other, as in the first embodiment, on the tapered surfaces to transmit the driving force.

Thus, according to the present embodiment, the coupling plate 42, which is fixed to the photoconductive drum 30, is rotated together with the output shaft 70 on the main body side in the same rotation direction and with the same angular velocity. This eliminates any errors in the transmission of the angular velocity between the engaging coupling members, and the angular velocity of the output shaft 70 is transmitted correctly for any photoconductive drum 30, so that an image can be recorded without positional misalignment.

In the first and the second embodiment, the rotating shaft of the photoconductive drum 30 is positioned by the rotating shaft of the coupling member on the main body side. To transmit an angular velocity precisely, the rotating shaft of the coupling plate 42 attached to the photoconductive drum 30 has to be matched with the rotating shaft of the coupling plate 61 on the main body side to rotate both coupling plates 42 and 61 together. When the coupling plates in the present invention are rotated together, the rotational center of the coupling plate 42 matches the rotational center of the coupling plate 61, so that the portions of the two coupling plates 42 and 61 that contact each other are not changed, and the two coupling plates 42 and 61 rotate in the same direction and with the same velocity.

Therefore, although it is also possible to position the center of the rotating shaft of the photoconductive drum 30 with a positioning means independent from the output shaft 70, it is preferable to couple the output shaft 70 and the photoconductive drum 30 together without slippage or play, and rotate the photoconductive drum while it is supported by the output shaft 70. Apart from the structures for supporting the photoconductive drum 30 with the output shaft 70 as shown in FIGS. 10 and 11, the two can be self-aligningly integrated by coupling between tongues, such as involute splines, and applying a rotational load.

Third Embodiment

Figure 12:
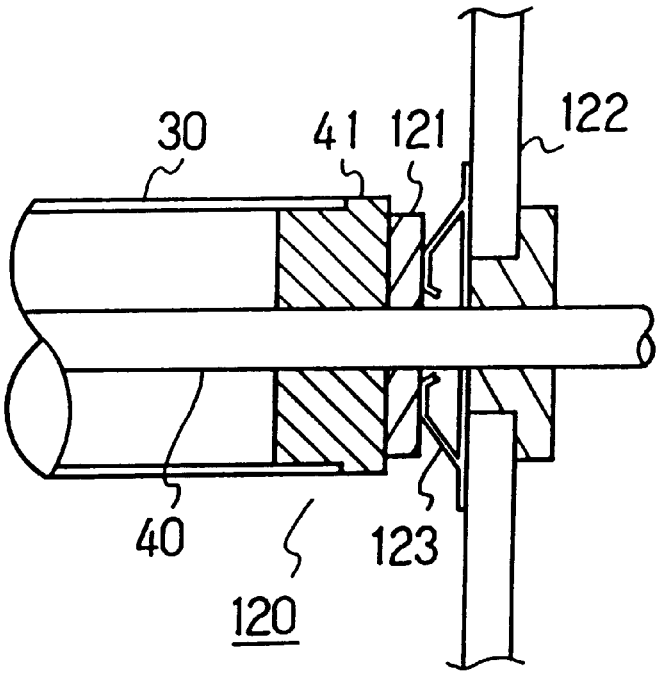
FIG. 12 is a cross section showing an end portion on the detent mechanism side of the photoconductive drum in the color image forming apparatus according to a third embodiment of the present invention.
Figure 13:
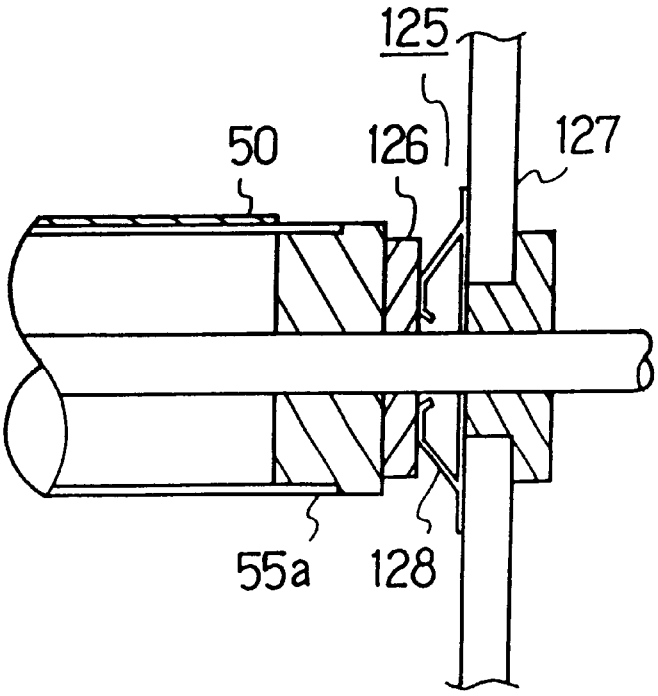
FIG. 13 is a cross section showing an end portion on the non-driven side not engaging the driving roller in the color image forming apparatus according to a third embodiment of the present invention.
Figure 14:
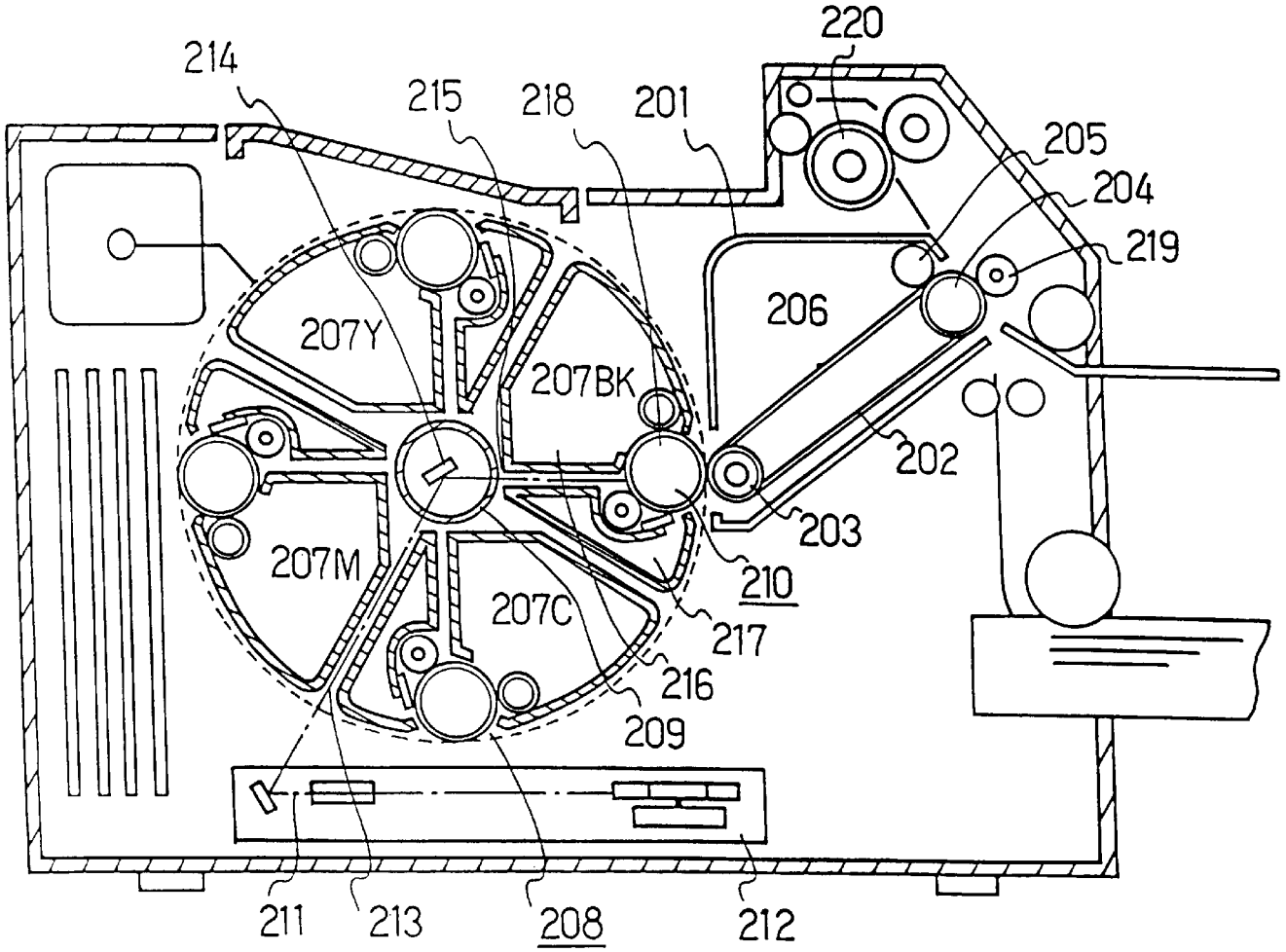
FIG. 14 PRIOR ART
FIG. 14 is a cross section of an entire conventional color image forming apparatus.

FIG. 12 is a cross-sectional view showing a portion of a photoconductive drum near the end of the detent mechanism side in a third embodiment of the color image forming apparatus according to the present invention. FIG. 13 is a cross-sectional view of the end portion of the driving roller near the non-driving side, where the driving roller does not engage the driving mechanism. What is different from the first embodiment, is that in the present embodiment, a photoconductive drum brake 120 and a roller brake 125 are provided.

As can be seen in FIG. 12, the photoconductive drum brake 120 presses a compression spring 123, which is attached to a side plate 122 and supports the photoconductive drum 30 at its end face, against a pad 121, thereby attaining a constant frictional load. This frictional load is adjusted so that a load torque of 500–800 gf×cm is applied steadily to the photoconductive drum 30. A total rotation load of about 1.5 kgf×cm is applied to the photoconductive drum 30 by this photoconductive drum brake 120 and the cleaner 36.

As can be seen in FIG. 13, the roller brake 125 presses a compression spring 128, which is attached to a side plate 127 and supports the driving roller 55A at its end face, against a pad 126, thereby attaining a constant frictional load. This frictional load is adjusted so that a load torque of 500–800 gf×cm is applied steadily to the roller 55A.

For comparison, in the first embodiment, the friction force when the photoconductive drum 30 was pressed against the intermediate transfer belt and the two slipped was about 125 gf. This corresponds to a rotation torque of about 200 gf×cm for the photoconductive drum 30 and the driving roller 55A, which are about 30 mm in diameter.

As has been pointed out in the first embodiment, the two operations below ensure that an image can be recorded with high precision and without positional misalignment, even when a plurality of photoconductive drums 30 with fluctuations in the dimensional accuracy are used alternately. First, any error in the transmission of angular velocity from the main body to the photoconductive drum is eliminated, and the angular velocity of the output shaft 70 is transmitted correctly to each photoconductive drum 30. Since the intermediate transfer belt 50 is driven at a constant velocity, a difference in the recording pitch due to eccentricity of the plurality of photoconductive drums 30 that are used alternately can be corrected by introducing slippage with the intermediate transfer belt 50, so that an image without positional misalignment can be recorded. Second, the rotation ratios of the output shaft 70 and the driving roller 55A, per rotation of the intermediate transfer belt 50, are set to integers, so that the difference between the angular velocity of the photoconductive drum 30 and the peripheral velocity of the intermediate transfer belt 50, which arises from the driving mechanism 90 on the main body side regardless of the photoconductive drums 30, can be synchronized for each color.

To realize these operations steadily, the photoconductive drum 30 and the driving roller 55A usually have to be rotated while being correctly coupled to the driving mechanism 90 or the driving gears, regardless of load variations.

In a well-known conventional apparatus with only one photoconductive drum, the above-mentioned torque variations of the apparatus also can be synchronized with the rotation of the intermediate transfer belt. However, in an apparatus where a plurality of photoconductive drums is used alternately, fluctuations in e.g. the eccentricity of the different photoconductive drums cannot be synchronized.

In the present embodiment, the photoconductive drum 30 is provided with a photoconductive drum brake 120 of 500–800 gf×cm. Therefore, the photoconductive drum 30 can be rotated at a constant velocity with the driving mechanism 90. This operation is explained in more detail in the following.

In the first embodiment, the developing roller 35*a* presses on the photoconductive drum 30 with a force of 2 kgf. The developing roller 35*a* and the photoconductive drum 30 rotate in opposite directions. The surface portion of the developing roller 35*a* that contacts the photoconductive drum 30 moves at 1.6 times the velocity and in the same direction as a corresponding surface portion of the photoconductive drum 30. A torque of about 1 kgf×cm is working to accelerate the photoconductive drum 30. On the other hand, a decelerating torque of about 1 kgf×cm is working on the photoconductive drum 30 from the cleaner 36 pressed against the photoconductive drum 30. These torques vary according to the eccentricity of the photoconductive drum 30. Furthermore, a torque of about 200 gf×cm arises at the transfer portion from friction with the intermediate transfer belt 50. In this transfer portion, the photoconductive drum 30 and the intermediate transfer belt 50, whose velocity fluctuates as well, are rotated with almost the same velocity. Therefore, the direction of the velocity difference in the transfer portion and the direction of the friction force change due to the velocity fluctuations of the two. The fluctuations in the peripheral velocity of the photoconductive drum 30 are caused by the eccentricity of the photoconductive drum 30. Moreover, the amount by which the photoconductive drum 30 bulges into the intermediate transfer belt 50 changes with the eccentricity of the photoconductive drum 30, so that the direction and the magnitude of the friction force in the transfer portion fluctuate. The maximum value for the combined torque on the photoconductive drum 30 in the direction accelerating the photoconductive drum 30, arising from friction between the photoconductive drum 30 and the developing roller 35*a* and friction between the photoconductive drum 30 and the intermediate transfer belt 50, was 1300 gf×cm.

In an apparatus using a plurality of photoconductive drums 30 alternately, the eccentricities of the photoconductive drums 30, which are the source for these fluctuations, are of different magnitude for each color, even when they are synchronized with the rotation of the driving mechanism 90, and their phases cannot be synchronized among the colors. Consequently, the friction force fluctuations in the transfer portion cannot be synchronized with the rotation of the intermediate transfer belt 50.

When these torque fluctuations work in a direction accelerating the photoconductive drum 30, the output shaft driving gear 71 separates from the motor side gear 72 in the driving mechanism 60 and the tongues of the coupling plate 61 on the main body side separate from the tongues of the coupling plate 42 attached to the photoconductive drum 30. Therefore, when the direction of the entire torque changes, the gears and the couplings keep disjoining over the backlash range and fluctuations in the angular velocity arise. These angular velocity fluctuations cause positional misalignment among the colors, since they are not synchronized with the intermediate transfer belt 50.

However, since in the present embodiment, a photoconductive drum brake 120 of 500–800 gf×cm is provided, the output driving gear 71, which is driven by the motor side gear 72, usually can be rotated steadily at a constant angular velocity. The friction load that the photoconductive drum brake 120 exerts on the photoconductive drum 30 is added to the friction load between the photoconductive drum 30 and the cleaner 36 (1 kgf×cm) and the combined photoconductive drum torque should be greater than the maximum value of 1300 gf×cm in the direction accelerating the photoconductive drum 30. When the first motor 95 starts its rotation in a certain period of time, the entire load of the driving mechanism 90 of course should not exceed a tolerable load for stable operation.

In the present embodiment, the photoconductive drum 30 and the developing roller 35*a* are pressed onto each other, and the developing roller 35*a* rotates faster than the photoconductive drum 30, but since with this developing method, the photoconductive drum 30 receives a large acceleration load from the developing roller 35A, the effect of the photoconductive drum brake 120 is conspicuous. In the case of a developing method where the photoconductive drum 30 does not receive such a large acceleration load, a sufficient effect can be attained with the friction load from the cleaner 36, so that a favorable image can be obtained.

Moreover, the driving roller 55A of the intermediate transfer belt 50 is provided with a 500–800 gf×cm roller brake 125. Therefore, the driving roller 55A can be rotated at a constant velocity by the driving mechanism 90. This operation is explained in more detail in the following.

When an intermediate transfer belt 50 such as shown in FIG. 1 is left suspended by the rollers 55, the intermediate transfer belt 50 deforms due to creep at the portion wrapped around the rollers 55. When this deformed intermediate transfer belt 50 is rotated while being suspended by the rollers 55, an acceleration load acts on the intermediate transfer belt 50 shortly before the resting position, and tries to fit the deformed portions around the rollers 55.

When this acceleration load is larger than the friction load of the bearings of the rollers 55, which suspend the intermediate transfer belt, then the intermediate transfer belt 50 rotates forward due to its own deformation. Thus, the force caused by the friction load of the roller 55 and the deformation of the intermediate transfer belt 50, that is, the belt rotation torque that the intermediate transfer belt 50 exerts on the driving roller 55A only with its own rotation and without any other interaction, is very unstable in direction and magnitude. Moreover, friction forces from photoconductive drums 30 that are not synchronized with the rotation of the intermediate transfer belt 50 are at work, as described above.

Therefore, the total driving shaft torque, which is the sum of the belt rotation torque and these friction forces on the driving roller 55A becomes unstable in magnitude and direction, and these fluctuations cannot be synchronized with the rotation of the intermediate transfer belt 50. When the total torque fluctuations act in a direction that accelerates the driving roller 55A, the roller gear 94 and the slow-down gear 93 separate. Therefore, when the direction of the total torque changes, the gear teeth keep disjoining over the backlash range, and fluctuations in the angular velocity arise. These angular velocity fluctuations cause positional misalignment among the colors, since they are not synchronized with the intermediate transfer belt 50. The total driving shaft torque is the sum of the belt rotation torque that the intermediate transfer belt 50 exerts on the driving roller 55A only with rotation and without any other interaction, and the torque on the driving roller 55A from friction between the photoconductive drum 30 and the intermediate transfer belt 50. The maximum value for the total driving shaft torque acting in a direction accelerating the driving roller 55A was 400 gf×cm.

However, since in the present embodiment, the driving roller 55A is provided with a roller brake 125 of 500–800 gf×cm, the roller gear 94, which is driven by the slow-down gear 93, usually can be rotated steadily at a constant angular velocity. The friction load that is exerted on the driving roller 55A should be larger than the maximum value of the total driving shaft torque in the direction accelerating the driving roller 55A.

In order to rotate the intermediate transfer belt 50 steadily, the friction force between the driving roller 55A and the intermediate transfer belt must be larger than the sum of the friction force between the photoconductive drum 30 and the intermediate transfer belt 50, and the friction loads of the driven rollers 55B, 55C, and 55D at rotation time. Moreover, when the first motor 95 starts rotation in a certain period of time, the entire load of the driving mechanism 90 of course should not exceed a tolerable load for stable operation.

Since in the present embodiment the image forming units 3 are switched while the photoconductive drum 30 and the intermediate transfer belt 50 rub against each other, the friction on the driving roller 55A brings about a conspicuous effect. The following explains this operation in more detail.

When the rotation load of the intermediate transfer belt 50 in the first embodiment is smaller than the friction force between the photoconductive drum 30 and the intermediate transfer belt 50, the intermediate transfer belt 50 is untimely rotated when the photoconductive drum 30 and the intermediate transfer belt 50 rub against each other while the image forming unit 3 is switched. When the image forming unit 3 is being switched, the rubbing begins while both are standing still, so that a static friction force bigger than the dynamic friction force during slippage arises. The intermediate transfer belt 50 rotates because of this static friction force from the friction with the photoconductive drum 30.

As has been outlined above, at the time of color changing, the image end (END) stops at a position that is only 15 mm downstream from the transfer position (downstream meaning here in rotation direction of the intermediate transfer belt 50), as has been outlined above. On the other hand, the rubbing length for entering and leaving the transfer position at switching time is about 10 mm. Therefore, when, at the time of color changing, the intermediate transfer belt 50 rotates in the direction opposite to the rotation direction at the time of image formation, the image end (END) of the image that has already been transferred onto the intermediate transfer belt 50 is moved into the rubbing region with the photoconductive drum 30. When the photoconductive drum 30 for the next color rubs along the intermediate transfer belt 50 in this region, the image on the intermediate transfer belt 50 is unfavorably corrupted.

However, since the present embodiment provides the driving roller 55A with a 500–800 gf×cm roller brake 125, the intermediate transfer belt 50 is not moved at switching time. Consequently, the image end (END) of a previous color image is not corrupted by rubbing with the photoconductive drum 30 for the next color. In the present embodiment, the static friction force of the friction between the photoconductive drum 30 and the intermediate transfer belt 50, acting as a rotation torque on the driving roller 55A, was about 400 gf×cm. The friction load applied to the driving roller 55A should be larger than the static friction force between the photoconductive drum 30 and the intermediate transfer belt 50. The friction force between the driving roller 55A and the intermediate transfer belt 50 must be greater than the static friction force between the photoconductive drum and the intermediate transfer belt 50, so that the intermediate transfer belt 50 is not moved by the friction with the photoconductive drum 30. Moreover, when the first motor 95 starts rotation in a certain period of time, the entire load of the driving mechanism 90 of course should not exceed a tolerable load for stable operation.

In the present embodiment, the rotation direction of the intermediate transfer belt 50 is opposite to the rubbing direction with the photoconductive drum 30 at the switching time. However, the invention is not limited to this structure, and can also be applied to an apparatus where the rotation direction of the intermediate transfer belt 50 is opposite to the rubbing direction with the photoconductive drum 30 at the switching time, and rubbing with the photoconductive drum 30 rotates the intermediate transfer belt in the advance direction. The leeway between reaching a constant rotation speed for the first motor 95 and detecting the position of the intermediate transfer belt 50 is about 10 mm. Therefore, when the intermediate transfer belt 50 is rotated in the advance direction due to rubbing with the photoconductive drum 30 at switching time, the interval between the position detection holes at the image top (TOP) and the sensor becomes shorter than the distance that the first motor 95 takes to reach a steady rotation for the image forming operation. In this case, the position of the intermediate transfer belt 50 is detected while the velocity of the intermediate transfer belt 50 has not yet been stabilized so that the various images are not superimposed in the correct position. However, the intermediate transfer belt 50 does not move when a roller brake 125 is employed. Consequently, a sufficient interval for the first motor 95 to reach a steady rotation can be ensured and positional misalignment prevented.

The present embodiment employs a cleaner 36 and a photoconductive drum brake 120, which apply a friction load to the photoconductive drum 30 that is greater than the maximum value of the total photoconductive drum torque, which rotates the photoconductive drum 30 in the advance direction and is the sum of the friction torque from the developing roller 35*a* on the photoconductive drum 30 and the friction torque from friction with the intermediate transfer belt 50. Thus, a driving means can drive the photoconductive drums 30 steadily at a constant velocity, regardless of eccentricity or phase of the photoconductive drums 30. This suppresses position misalignment between the colors.

Moreover, the friction force acting on the intermediate transfer belt 50 caused by the photoconductive drum 30 is adjusted so that it is smaller than the friction force with which the driving roller 55A drives the intermediate transfer belt 50, and the roller brake 125 applies a bigger load than the maximum value of the total driving shaft torque, which rotates the driving roller 55A in the advance direction and is the sum of the belt rotation torque on the intermediate transfer belt 50 at rotation time and the friction torque from the friction with photoconductive drum 30. Thus, the driving mechanism 90 can rotate the driving roller 55A and the intermediate transfer belt 50 steadily at a constant velocity, regardless of eccentricity or phase of the photoconductive drums 30. This suppresses position misalignment between the colors.

Moreover, letting the photoconductive drum 30 rub along the intermediate transfer belt 50 when the image forming unit 3 is switched and providing a roller brake 125 with a load that is bigger than the rotation torque resulting from the static friction between photoconductive drum 30 and the intermediate transfer belt 50 allows color changing with a simple structure and prevents image corruption and color misalignment.

The present embodiment used a compression spring 123 attached to the side plate 122 supporting the photoconductive drum 30 on the end face of the photoconductive drum 30 as the photoconductive drum brake 120 to be pressed against pad 121. However, the present invention is not limited to this structure, and instead of using a compression spring, the pad 121 could also be pressed against the photoconductive drum 30 with the thrust force that presses the output shaft 70 against the photoconductive drum shaft 40. In that case, the same effect can be attained with a simpler structure.

Fourth Embodiment

In the above first embodiment, the outer diameters of the photoconductive drum 30 and the driving roller 55A are 30 mm, the perimeter of the intermediate transfer belt 50 is 377 mm, which is four times the perimeter of a circle with 30 mm diameter, and the outer peripheral velocities of the photoconductive drum 30 and the intermediate transfer belt 50 are adjusted to almost the same velocity, but the diameter of the photoconductive drum 30 or the perimeter of the intermediate transfer belt 50 and the diameter of the driving roller 55A can vary for some percent from these values.

For example, when the diameter of the photoconductive drum 30 is chosen to be 1% larger, i.e. 30.3 mm, and the same driving mechanism 90 as in the first embodiment is employed, then the peripheral velocity of the photoconductive drum 30 becomes 1% higher than that of the intermediate transfer belt 50. With this structure, the outer peripheral velocity of the photoconductive drum 30 is usually faster than the peripheral velocity of the intermediate transfer belt 50, and the photoconductive drum 30 and the intermediate transfer belt 50 are constantly slipping in a certain direction when set into motion, even when velocity fluctuations occur for the photoconductive drum 30 and the intermediate transfer belt 50 due to eccentric components in the photoconductive drum 30 and the driving roller 55A or the gears of the driving mechanism 90. The direction in which a friction force is applied is usually constant and stable, because the difference of the peripheral velocities between the intermediate transfer belt 50 and the photoconductive drum 30 is maintained in one direction. As a result of the friction forces working on the intermediate transfer belt, the fluctuations due to a change of the peripheral velocity variations of the photoconductive drum 30 disappear. Therefore, of the velocity fluctuations of the intermediate transfer belt 50, the components that are not synchronized with the rotation of the intermediate transfer belt 50, which are generated by fluctuations in the peripheral velocity of the photoconductive drum 30, can be reduced. Moreover, since the direction of the friction force is the direction usually compensating the acceleration torque that the photoconductive drum 30 receives from the developing roller 35, the load that the photoconductive drum brake 120 exerts on the photoconductive drum 30 can be chosen to be smaller.

Conversely, when the outer peripheral velocity of the photoconductive drum 30 is slower than the peripheral velocity of the intermediate transfer belt 50, the friction force usually serves as a decelerating load for the intermediate transfer belt 50, which can cancel the acceleration load in rotation direction due to creep deformation of the intermediate transfer belt 50. Consequently, the load torque that the roller brake 125 applies to the driving roller 55A can be reduced.

In the first embodiment, the intermediate transfer belt 50 runs 15 mm until the first motor 95 reaches a constant velocity after being started. The intermediate transfer belt 50 runs 10 mm until its position detection holes reach the position of a sensor and are detected. Thereafter, it runs 1 mm until exposure begins. In this embodiment, the play after the first motor 95 reaches a constant rotation velocity until position detection of the intermediate transfer belt 50 is 10 mm. After exposure begins, the intermediate transfer belt 50 runs about 45 mm until the image on the photoconductive drum 30 comes from the exposure position to a primary transfer position. Therefore, from the start of the of the first motor 95 to the beginning of the primary transfer, the intermediate transfer belt 50 runs a total of 71 mm. After the transfer of one color toner image, the image end (END) stops 15 mm downstream from the transfer position. Therefore, an image cannot be transferred onto the intermediate transfer belt 50 over a total of 86 mm. Since the total length of the intermediate transfer belt 50 is 377 mm, the longest possible image length is 291 mm. Considering the length of an A4 size recording paper in the longitudinal direction (297 mm), 6 mm of blank margin have to be formed.

However, if the diameters of the rollers 55 suspending the intermediate transfer belt 50 are enlarged 1%, the total length of the intermediate transfer belt 50 becomes about 4 mm longer. When these 4 mm are applied to the blank margin portion, the image length can be made 4 mm longer. Alternatively, retaining the blank margin portion at 6 mm ensures sufficiently long tolerance for rubbing with the photoconductive drum 30 at start, stop or color change.

When the eccentricity of the photoconductive drum 30 and the driving roller 50 is 50 $\mu$m and the eccentric component of the gears of the driving mechanism 90 is 10 $\mu$m, then a peripheral velocity difference of at least 1% becomes necessary to let the peripheral velocity difference between the photoconductive drum 30 and the intermediate transfer belt 50 point constantly into the same direction. Moreover, to prevent corruption of the transfer image the peripheral velocity difference should be not more than 10%, preferably not more than 5%. Therefore, when the rotation frequency of the photoconductive drum 30 and the driving roller 55A is the same, the radius of the photoconductive drum 30 should vary 1 to 10% from the sum of the radius of the driving roller 55A plus the thickness of the intermediate transfer belt 50.

Even when a peripheral velocity difference is employed by changing the diameter of the photoconductive drum 30 or the diameter of the driving roller 55A and thus changing their peripheral velocities, the output driving gear 71 and the driving roller 55A can have the same rotation frequency, and synchronous rotation of the photoconductive drum 30 and the intermediate transfer belt 50 can be ensured. It is preferable that appropriate values for the outer diameter of the driving roller 55A and the perimeter of the intermediate transfer belt 50 are chosen considering the thickness of the intermediate transfer belt 50, and that the rotation ratio of the driving roller 55A per rotation of the intermediate transfer belt 50 is adjusted to exactly an integer.

At the primary transfer portion of the image forming position of the present embodiment, the peripheral velocity of the photoconductive drum 30 is constantly higher than the peripheral velocity of the intermediate transfer belt 50 or vice versa, so that, from the friction forces acting on the photoconductive drum 30, the intermediate transfer belt 50 and the driving roller 55A, the fluctuations due to the change of eccentric components of the photoconductive drum 30 can be reduced. Therefore, out of the velocity fluctuations of the intermediate transfer belt 50, components that are not synchronized with the rotation of the intermediate transfer belt 50 and are caused by fluctuations in the peripheral velocity of the photoconductive drum 30 can be reduced. This can prevent a relative positional misalignment between the colors that are superimposed on the image.

In the above embodiments, the image forming unit 3 comprising the photoconductive drum 30 and the transfer belt unit 5 comprising the intermediate transfer belt 50 were detachable from the apparatus main body 1, but the present invention is by no means limited to this structure. A configuration in which the detachment of the entire unit is difficult, and only toner refilling and disposal of used toner are easy, is possible.

Moreover, in the above embodiments, examples were given of an apparatus in which the main body rotatably supports the carriage 2 and the image forming units 3 are rotated, but the present invention is not limited to this structure. The image forming units 3 can also be lined up in a linear arrangement and activated by direct advance and retreat.

The color image forming apparatus according to the present invention, realizes a reliable color alignment of high precision with a simple structure.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color image forming apparatus comprising:

a plurality of image forming units, each image forming unit comprising a developing device for a different color and a photoconductive drum having driven coupling means;

conveying means for switching the plurality of image forming units by moving them successively between an image forming position and a waiting position;

photoconductive drum driving means removably engaging the driven coupling means of the image forming unit that is positioned in the image forming position and having one driving coupling means for coaxially rotating the photoconductive drum of the image forming unit positioned in the image forming position together as one body;

transfer means for forming a color image on a transfer device by transferring and successively superimposing toner images formed with the developing device on the photoconductive drum onto the transfer device; and transfer device driving means for driving the transfer device at a certain velocity;

wherein, at a contact portion where the photoconductive drum positioned in the image forming position contacts the transfer device, a peripheral velocity of either the photoconductive drum or the transfer device during use is higher than a peripheral velocity of the other.

2. The color image forming apparatus according to claim 1, wherein during image transfer, in the contact portion where toner is transferred from the photoconductive drum that is positioned in the image forming position to the transfer device, the peripheral velocity of the transfer device is constantly higher than the peripheral velocity of the photoconductive drum at its area of contact with the transfer device.

3. A color image forming apparatus, comprising:

a plurality of image forming units, each image forming unit comprising a developing device for a different color and a photoconductive drum having driven coupling means;

conveying means for switching the plurality of image forming units by moving them successively between an image forming position and a waiting position;

photoconductive drum driving means removably engaging the driven coupling means of the image forming unit that is positioned in the image forming position and having a driving coupling means for coaxially rotating the photoconductive drum together as one body;

transfer means for forming a color image on a transfer device by transferring and successively superimposing toner images formed with the developing device on the photoconductive drum onto the transfer device;

transfer device driving means form driving the transfer device at a certain velocity;

wherein the transfer device is an intermediate transfer belt supported by at least one driven shaft, which is drivably supported by a driving shaft that rotates the driven shaft at a certain rotation frequency with the transfer device driving means; and a driving shaft load means, which applies to said driving shaft a friction load that is greater than a maximum value of a total driving shaft torque that rotates said driving shaft in an advance direction and is a sum of a belt rotation torque that said intermediate transfer belt exerts on said driving shaft when rotating and a friction torque in said driving shaft from friction between said intermediate transfer belt and said photoconductive drum;

wherein a friction force acting between the intermediate transfer belt and the photoconductive drum positioned in the image forming position is smaller than a friction force with which the driving shaft drives said intermediate transfer belt.

4. The color image forming apparatus according to claim 3, wherein the driven shaft for supporting the intermediate transfer belt is integrated with said intermediate transfer belt into transfer belt unit, and said transfer belt unit is detachable from the apparatus.

5. A color image forming apparatus comprising:

a plurality of image forming units, each image forming unit comprising a developing device for a different color and a photoconductive drum having driven coupling means;

conveying means for switching the plurality of image forming units by moving them successively between an image forming position and a waiting position;

photoconductive drum driving means removably engaging the driven coupling means of the image forming unit that is positioned in the image forming position and having driving coupling means for coaxially rotating the photoconductive drum together as one body;

a developing roller with which the developing device conveys toner onto the photoconductive drum and which presses against the photoconductive drum, a peripheral velocity of the developing roller during use being higher than a peripheral velocity of the photoconductive drum; and photoconductive drum load means, which applies to the photoconductive drum a friction load that is greater than a maximum value of a total photoconductive drum torque that rotates the photoconductive drum in an advance direction and is a sum of a friction torque between the photoconductive drum and the developing device and a friction torque between the photoconductive drum positioned in the image forming position and a transfer device.

6. A color image forming apparatus comprising:

a plurality of image forming units, each image forming unit comprising a developing device for a different color and a photoconductive drum;

conveying means for switching said plurality of image forming units by moving them successively between an image forming position and a waiting position;

photoconductive drum driving means, detachably engaging said photoconductive drum, for rotating said photoconductive drum positioned in the image forming position;

exposure means for exposing said photoconductive drum that is positioned in the image forming position;

transfer means for forming a color image comprising a plurality of superimposed color toner images on an intermediate transfer belt by successively transferring and superimposing toner images, formed with said developing device on said photoconductive drum that is positioned in the image forming position, onto said intermediate transfer belt;

a plurality of belt shafts for supporting and rotating said intermediate transfer belt;

transfer device driving means for driving at least one of said belt shafts at image formation time as a driving shaft at a certain rotation frequency, and stopping said driving shaft when said conveying means is conveying said image forming units;

driving shaft load means for applying a rotation load to said driving shaft;

wherein said conveying means conveys said image forming unit for switching while said photoconductive drum rubs along said intermediate transfer belt; and a rotation load exerted on said driving shaft by said driving shaft load means is greater than a rotation torque exerted on said driving shaft by a static friction force of said photoconductive drum and said intermediate transfer belt.

7. The color image forming apparatus according to claim 6, wherein the belt shafts for supporting the intermediate transfer belt are integrated with said intermediate transfer belt into a transfer belt unit, and said transfer belt unit is detachable from the apparatus.

8. The color image forming apparatus according to claim 6, wherein the image forming units are detachable from the apparatus.

9. A color image forming apparatus comprising:

a plurality of image forming units, each image forming unit comprising a developing device for a different color and a photoconductive drum;

conveying means for switching said plurality of image forming units by moving them successively between an image forming position and a waiting position;

photoconductive drum driving means, detachably engaging said photoconductive drum, for rotating said photoconductive drum positioned in the image forming position;

exposure means for exposing said photoconductive drum that is positioned in the image forming position;

transfer means for forming a color image comprising a plurality of superimposed color toner images on an intermediate transfer belt by successively transferring and superimposing toner images, formed with said developing device on said photoconductive drum that is positioned in the image forming position, onto said intermediate transfer belt;

a plurality of belt shafts for supporting and rotating said intermediate transfer belt;

transfer device driving means for driving said intermediate transfer belt with at least one of said belt shafts at image formation time as a driving shaft;

driving shaft load means for applying a rotation load to said driving shaft;

wherein a friction force acting between the intermediate transfer belt and the photoconductive drum positioned in the image forming position is smaller than a friction force with which said driving shaft drives said intermediate transfer belt, and a friction load that said driving shaft load means applies to said driving shaft is greater than a maximum value of a total driving shaft torque that rotates said driving shaft in an advance direction and is a sum of a belt rotation torque that said intermediate transfer belt exerts on said driving shaft when rotating and a friction torque in said driving shaft from friction between said intermediate transfer belt and said photoconductive drum positioned in the image forming position.

10. The color image forming apparatus according to claim 9, wherein rotation ratios of the photoconductive drum and the driving shaft, per rotation of the intermediate transfer belt at image formation time, are integers.

11. The color image forming apparatus according to claim 9, wherein the belt shafts for supporting the intermediate transfer belt are integrated with said intermediate transfer belt into a transfer belt unit, and said transfer belt unit is detachable from the apparatus.

12. The color image forming apparatus according to claim 9, wherein the image forming units are detachable from the apparatus.

13. A color image forming apparatus comprising:

a plurality of image forming units, each image forming unit comprising a developing device for a different color and a photoconductive drum;

conveying means for switching said plurality of image forming units by moving them successively between an image forming position and a waiting position;

photoconductive drum driving means, detachably engaging one photoconductive drum each time, for rotating said photoconductive drum positioned in the image forming position;

exposure means for exposing said photoconductive drum that is positioned in the image forming position;

transfer means for forming a color image comprising a plurality of superimposed color toner images on a transfer device by successively transferring and superimposing toner images, formed with said developing device on said photoconductive drum that is positioned in the image forming position, onto said transfer device;

transfer device driving means for driving said transfer device with constant velocity at image formation time;

wherein, during image transfer, at a transfer portion where toner is transferred from said photoconductive drum that is positioned in the image forming position to the transfer device, a peripheral velocity of either said photoconductive drum or said transfer device is constantly higher than a peripheral velocity of the other.

14. The color image forming apparatus according to claim 13, wherein, during image transfer, in the transfer portion where toner is transferred from said photoconductive drum that is positioned in the image forming position to the transfer device, the peripheral velocity of said transfer device is constantly higher than the peripheral velocity of said photoconductive drum at its area of contact with said transfer device.

15. The color image forming apparatus according to claim 13, wherein a rotation ratio of each photoconductive drum positioned in the image forming position, per rotation of the transfer device at the time of image formation, is an integer.

16. The color image forming apparatus according to claim 13, wherein the image forming units are detachable from the apparatus.

17. The color image forming apparatus according to claim 13, wherein the transfer device is an intermediate transfer belt.

18. The color image forming apparatus according to claim 17, wherein a belt shaft for supporting the intermediate transfer belt is integrated with said intermediate transfer belt into a transfer belt unit, and said transfer belt unit is detachable from the apparatus.

19. An image forming unit comprising:

a developing device for a certain color, a photoconductive drum having load means for applying a friction force to an end portion of the photoconductive drum, and driven coupling means coaxially engaging driving coupling means on a main body side of a color image forming apparatus, a developing roller with which the developing device conveys toner onto the photoconductive drum and which presses against the photoconductive drum, a peripheral velocity of the developing roller during use being higher than a peripheral velocity of the photoconductive drum; and photoconductive drum load means, which applies to the photoconductive drum a friction load that is greater than a maximum value of a total photoconductive drum torque that rotates the photoconductive drum in an advance direction and is a sum of a friction torque between the photoconductive drum and the developing device and a friction torque between the photoconductive drum positioned in the image forming position and a transfer device;

wherein the color image forming apparatus comprising a plurality of image forming units; conveying means for switching the plurality of image forming units by moving them successively between an image forming position and a waiting position; photoconductive drum driving means removably engaging the driven coupling means of the image forming unit that is positioned in the image forming position and having driving coupling means for coaxially rotating the photoconductive drum together as one body; the developing roller; and the photoconductive drum load means;

wherein the image forming unit is detachable from the main body of the color image forming apparatus.

20. A transfer belt unit comprising:

a driving shaft on a main body side of a color image forming apparatus;

at least one driven shaft, which is driven by the driving shaft; and an intermediate transfer belt supported by the at least one driven shaft;

wherein the color image forming apparatus comprises a plurality of image forming units, each image forming unit comprising a developing device for a different color and a photoconductive drum having driven coupling means; conveying means for switching the plurality of image forming units by moving them successively between an image forming position and a waiting position; photoconductive drum driving means removably engaging the driven coupling means of the image forming unit that is positioned in the image forming position and having driving coupling means for coaxially rotating the photoconductive drum together as one body; transfer means for forming a color image on a transfer device by transferring and successively superimposing toner images formed with the developing device on the photoconductive drum onto the transfer device; transfer device driving means for driving the transfer device at a certain velocity; in which the transfer device is the intermediate transfer belt supported by the at least one driven shaft, which is drivably supported by the driving shaft that rotates the at least one driven shaft at a certain rotation frequency with the transfer device driving means; a driving shaft load means, which applies to the driving shaft a friction load that is greater than a maximum value of a total driving shaft torque that rotates the driving shaft in an advance direction and is a sum of a belt rotation torque that the intermediate transfer belt exerts on the driving shaft when rotating and a friction torque in the driving shaft from friction between the intermediate transfer belt and the photoconductive drum; in which a friction force acting between the intermediate transfer belt and the photoconductive drum positioned in the image forming position is smaller than a friction force with which the driving shaft drives the intermediate transfer belt;

wherein the transfer belt unit is detachable from the main body of the color image forming apparatus.

21. An image forming unit comprising:

a developing device for a certain color, and a photoconductive drum having driven coupling means engaging driving coupling means on a main body side of a color image forming apparatus, wherein the color image forming apparatus comprises a plurality of image forming units; conveying means for switching the plurality of image forming units by moving them successively between an image forming position and a waiting position; photoconductive drum driving means, detachably engaging the photoconductive drum for rotating the photoconductive drum positioned in the image forming position; exposure means for exposing the photoconductive drum that is positioned in the image forming position; transfer means for forming a color image comprising a plurality of superimposed color toner images on an intermediate transfer belt by successively transferring and superimposing toner images, formed with the developing device on the photoconductive drum that is positioned in the image forming position, onto the intermediate transfer belt; a plurality of belt shafts for supporting and rotating the intermediate transfer belt; transfer device driving means for driving at least one of the belt shafts at image formation time as a driving shaft at a certain rotation frequency, and stopping the driving shaft when the conveying means is conveying the image forming units; driving shaft load means for applying a rotation load to the driving shaft; wherein the conveying means conveys the image forming unit for switching while the photoconductive drum rubs along the intermediate transfer belt; and a rotation load exerted on the driving shaft by the driving shaft load means is greater than a rotation torque exerted on the driving shaft by a static friction force of the photoconductive drum and the intermediate transfer belt;

wherein the image forming unit is detachable from the main body of the color image forming apparatus.

22. An image forming unit comprising:

a developing device for a certain color, and a photoconductive drum having driven coupling means engaging driving coupling means on a main body side of a color image forming apparatus, wherein the color image forming apparatus comprises a plurality of image forming units; conveying means for switching the plurality of image forming units by moving them successively between an image forming position and a waiting position; photoconductive drum driving means, detachably engaging the photoconductive drum, for rotating the photoconductive drum positioned in the image forming position; exposure means for exposing the photoconductive drum that is positioned in the image forming position; transfer means for forming a color image comprising a plurality of superimposed color toner images on an intermediate transfer belt by successively transferring and superimposing toner images, formed with the developing device on the photoconductive drum that is positioned in the image forming position, onto the intermediate transfer belt; a plurality of belt shafts for supporting and rotating the intermediate transfer belt; transfer device driving means for driving the intermediate transfer belt with at least one of the belt shafts at image formation time as a driving shaft; driving shaft load means for applying a rotation load to the driving shaft; wherein a friction force acting between the intermediate transfer belt and the photoconductive drum positioned in the image forming position is smaller than a friction force with which the driving shaft drives the intermediate transfer belt, and a friction load that the driving shaft load means applies to the driving shaft is greater than a maximum value of a total driving shaft torque that rotates the driving shaft in an advance direction and is a sum of a belt rotation torque that the intermediate transfer belt exerts on the driving shaft when rotating and a friction torque in the driving shaft from friction between the intermediate transfer belt and the photoconductive drum positioned in the image forming position;

wherein the image forming unit is detachable from the main body of the color image forming apparatus.

23. An image forming unit comprising:

a developing device for a certain color, and a photoconductive drum having driven coupling means engaging driving coupling means on a main body side of a color image forming apparatus, wherein the color image forming apparatus comprises a plurality of image forming units; conveying means for switching the plurality of image forming units by moving them successively between an image forming position and a waiting position; photoconductive drum driving means, detachably engaging the photoconductive drum, for rotating the photoconductive drum positioned in the image forming position; exposure means for exposing the photoconductive drum that is positioned in the image forming position; transfer means for forming a color image comprising a plurality of superimposed color toner images on a transfer device by successively transferring and superimposing toner images, formed with the developing device on the photoconductive drum that is positioned in the image forming position, onto the transfer device; transfer device driving means for driving the transfer device with constant velocity at image formation time; wherein, during image transfer, at a transfer portion where toner is transferred from the photoconductive drum that is positioned in the image forming position to the transfer device, a peripheral velocity of either the photoconductive drum or the transfer device is constantly higher than a peripheral velocity of the other, wherein the image forming unit is detachable from the main body of the color image forming apparatus.

24. A transfer belt unit comprising:

a driving shaft on a main body side of a color image forming apparatus;

at least one driven shaft, which is driven by the driving shaft; and an intermediate transfer belt supported by the at least one driven shaft;

wherein the color image forming apparatus comprises a plurality of image forming units, each image forming unit comprising a developing device for a different color and a photoconductive drum; conveying means for switching the plurality of image forming units by moving them successively between an image forming position and a waiting position; photoconductive drum driving means, detachably engaging the photoconductive drum, for rotating the photoconductive drum positioned in the image forming position; exposure means for exposing the photoconductive drum that is positioned in the image forming position; transfer means for forming a color image comprising a plurality of superimposed color toner images on the intermediate transfer belt by successively transferring and superimposing toner images, formed with the developing device on the photoconductive drum that is positioned in the image forming position, onto the intermediate transfer belt; a plurality of belt shafts for supporting and rotating the intermediate transfer belt; transfer device driving means for driving at least one of the belt shafts at image formation time as the driving shaft at a certain rotation frequency, and stopping the driving shaft when the conveying means is conveying the image forming units; driving shaft load means for applying a rotation load to the driving shaft; wherein the conveying means conveys the image forming unit for switching while the photoconductive drum rubs along the intermediate transfer belt; and a rotation load exerted on the driving shaft by the driving shaft load means is greater than a rotation torque exerted on the driving shaft by a static friction force of the photoconductive drum and the intermediate transfer belt;

wherein the transfer belt unit is detachable from the main body of the color image forming apparatus.

25. A transfer belt unit comprising:

a driving shaft on a main body side of a color image forming apparatus;

at least one driven shaft, which is driven by the driving shaft; and an intermediate transfer belt supported by the at least one driven shaft;

wherein the color image forming apparatus comprises a plurality of image forming units, each image forming unit comprising a developing device for a different color and a photoconductive drum; conveying means for switching the plurality of image forming units by moving them successively between an image forming position and a waiting position; photoconductive drum driving means detachably engaging the photoconductive drum, for rotating the photoconductive drum positioned in the image forming position; exposure means for exposing the photoconductive drum that is positioned in the image forming position; transfer means for forming a color image comprising a plurality of superimposed color toner images on the intermediate transfer belt by successively transferring and superimposing toner images, formed with the developing device on the photoconductive drum that is positioned in the image forming position, onto the intermediate transfer belt; a plurality of belt shafts for supporting and rotating the intermediate transfer belt; transfer device driving means for driving the intermediate transfer belt with at least one of the belt shafts at image formation time as the driving shaft; driving shaft load means for applying a rotation load to the driving shaft; wherein a friction force acting between the intermediate transfer belt and the photoconductive drum positioned in the image forming position is smaller than a friction force with which the driving shaft drives the intermediate transfer belt, and a friction load that the driving shaft load means applies to the driving shaft in an advance direction and is a sum of a belt rotation torque that the intermediate transfer belt exerts on the driving shaft when rotating and a friction torque in the driving shaft from friction between the intermediate transfer belt and the photoconductive drum positioned in the image forming position;

wherein the transfer belt unit is detachable from the main body of the color image forming apparatus.

26. A transfer belt unit comprising:

a driving shaft on a main body side of a color image forming apparatus;

at least one driven shaft, which is driven by the driving shaft; and an intermediate transfer belt supported by the at least one driven shaft;

wherein the color image forming apparatus comprises a plurality of image forming units, each image forming unit comprising a developing device for a different color and a photoconductive drum; conveying means for switching the plurality of image forming units by moving them successively between an image forming position and a waiting position; photoconductive drum driving means, detachably engaging the photoconductive drum, for rotating the photoconductive drum positioned in the image forming position; exposure means for exposing the photoconductive drum that is positioned in the image forming position; transfer means for forming a color image comprising a plurality of superimposed color toner images on a transfer device by successively transferring and superimposing toner images, formed with the developing device on the photoconductive drum that is positioned in the image forming position, onto the transfer device; transfer device driving means for driving the transfer device with constant velocity at image formation time; wherein during image transfer, at a transfer portion where toner is transferred from the photoconductive drum that is positioned in the image forming position to the transfer device, a peripheral velocity of either the photoconductive drum or the transfer device is constantly higher than a peripheral velocity of the other; in which the transfer device is the intermediate transfer belt;

wherein the transfer belt unit is detachable from the main body of the color image forming apparatus.

* * * * *